US011642579B2

(12) United States Patent
Mizutani

(10) Patent No.: US 11,642,579 B2
(45) Date of Patent: May 9, 2023

(54) GOLF CLUB HEAD

(71) Applicant: Sumitomo Rubber Industries, Ltd., Hyogo (JP)

(72) Inventor: Naruhiro Mizutani, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/691,176

(22) Filed: Mar. 10, 2022

(65) Prior Publication Data

US 2022/0288473 A1 Sep. 15, 2022

(30) Foreign Application Priority Data

Mar. 15, 2021 (JP) ..... JP2021-41039

(51) Int. Cl.
*A63B 53/06* (2015.01)
*A63B 53/08* (2015.01)
*A63B 53/04* (2015.01)

(52) U.S. Cl.
CPC ..... *A63B 53/06* (2013.01); *A63B 53/08* (2013.01); *A63B 53/0466* (2013.01)

(58) Field of Classification Search
CPC ..... A63B 53/04; A63B 2053/0491; A63B 2053/0495
USPC ..... 473/324–350
See application file for complete search history.

(56) References Cited

U.S. PATENT DOCUMENTS 1,627,848 A * 5/1927 Hubbard ..... A63B 60/00 473/343
2010/0062874 A1* 3/2010 Young ..... A63B 53/0466 473/324
2022/0288473 A1* 9/2022 Mizutani ..... A63B 53/06

FOREIGN PATENT DOCUMENTS

CN 102202747 A * 9/2011 ..... A63B 53/0466
JP 02131788 A * 5/1990
JP 2011-010722 A 1/2011

* cited by examiner

*Primary Examiner* — Alvin A Hunter
(74) *Attorney, Agent, or Firm* — Studebaker & Brackett PC

(57) ABSTRACT

A golf club head has a face portion, a crown portion, and a sole portion. The golf club head includes a weight member that is configured to be wound, a first wound portion around which a first part of the weight member is to be wound, and a second wound portion that is disposed apart from the first wound portion and around which a second part of the weight member is to be wound. In the golf club head, a position of a center of gravity of the golf club head is adjusted by changing a weight ratio of the first part to the second part. At least either the first wound portion or the second wound portion may be rotatable in a reel-in direction and a reel-out direction.

20 Claims, 21 Drawing Sheets

GOLF CLUB HEAD

CROSS REFERENCE TO RELATED APPLICATION

The present application claims priority to Japanese Patent Application No. 2021-041039 filed on Mar. 15, 2021. The entire contents of this Japanese Patent Application are hereby incorporated by reference.

BACKGROUND

Technical Field

The present disclosure relates to a golf club head.

Description of the Related Art

There has been known a golf club head in which the position of the center of gravity of the head can be adjusted. JP2011-010722 A discloses a golf club head including a weight body that can move on a guide groove.

SUMMARY

The inventor of the present disclosure has found a new structure capable of adjusting the position of the center of gravity of a head. This new structure exhibits new advantageous effects brought by the structure.

The present disclosure provides a golf club head having a new structure that includes a mechanism of adjusting the center of gravity of the head.

In one aspect, a golf club head according to the present disclosure includes a face portion, a crown portion, and a sole portion. This head includes a weight member that is configured to be wound, a first wound portion around which a first part of the weight member is to be wound, and a second wound portion that is disposed apart from the first wound portion and around which a second part of the weight member is to be wound. The position of a center of gravity of the head is adjusted by changing a weight ratio of the first part to the second part.

DESCRIPTION OF THE PREFERRED EMBODIMENTS

Hereinafter, embodiments will be described in detail with appropriate references to the accompanying drawings.

Figure 21:
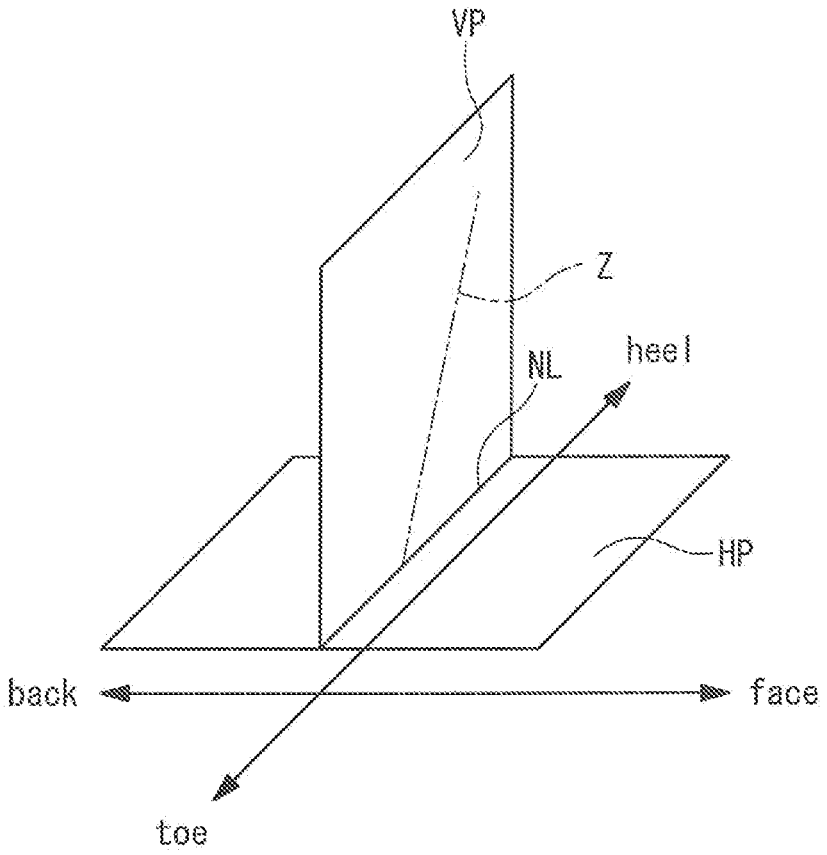
FIG. 21 is a conceptual diagram for illustrating a toe-heel direction and a face-back direction.

In the present disclosure, a reference state, a reference perpendicular plane, a face-back direction, a toe-heel direction, and an up-down direction are defined as follows. The reference state is defined as a state where a head is placed at a predetermined lie angle and real loft angle on a horizontal plane HP. As shown in FIG. 21, in the reference state, a center line Z of a hosel hole is contained in a plane VP that is perpendicular to the horizontal plane HP. The plane VP is defined as the reference perpendicular plane. The predetermined lie angle and real loft angle are shown in a product catalog, for example.

In the present disclosure, the toe-heel direction is the direction of an intersection line NL between the reference perpendicular plane VP and the horizontal plane HP (see FIG. 21).

In the present disclosure, the face-back direction is a direction that is perpendicular to the toe-heel direction and is parallel to the horizontal plane HP.

In the present disclosure, the up-down direction is a direction that is perpendicular to the toe-heel direction and is perpendicular to the face-back direction. In other words, the up-down direction in the present disclosure is a direction perpendicular to the horizontal plane HP.

In the present disclosure, a face center Fc is defined. The face center Fc is determined in the following manner. First, a point Pr is selected roughly at the center of a face outer surface in the up-down direction and the toe-heel direction. Next, a plane that passes through the point Pr, extends in the direction of a line normal to the face outer surface at the point Pr, and is parallel to the toe-heel direction is determined. An intersection line between this plane and the face outer surface is drawn, and a midpoint Px of this intersection line is determined. Next, a plane that passes through the midpoint Px, extends in the direction of a line normal to the face outer surface at the midpoint Px, and is parallel to the up-down direction is determined. An intersection line between this plane and the face outer surface is drawn, and a midpoint Py of this intersection line is determined. Next, a plane that passes through the midpoint Py, extends in the direction of a line normal to the face outer surface at the midpoint Py, and is parallel to the toe-heel direction is determined. An intersection line between this plane and the face outer surface is drawn, and a midpoint Px of this intersection line is newly determined. Next, a plane that passes through this newly-determined midpoint Px, extends in the direction of a line normal to the face outer surface at this midpoint Px, and is parallel to the up-down direction is determined. An intersection line between this plane and the face outer surface is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center Fc.

Figure 1:
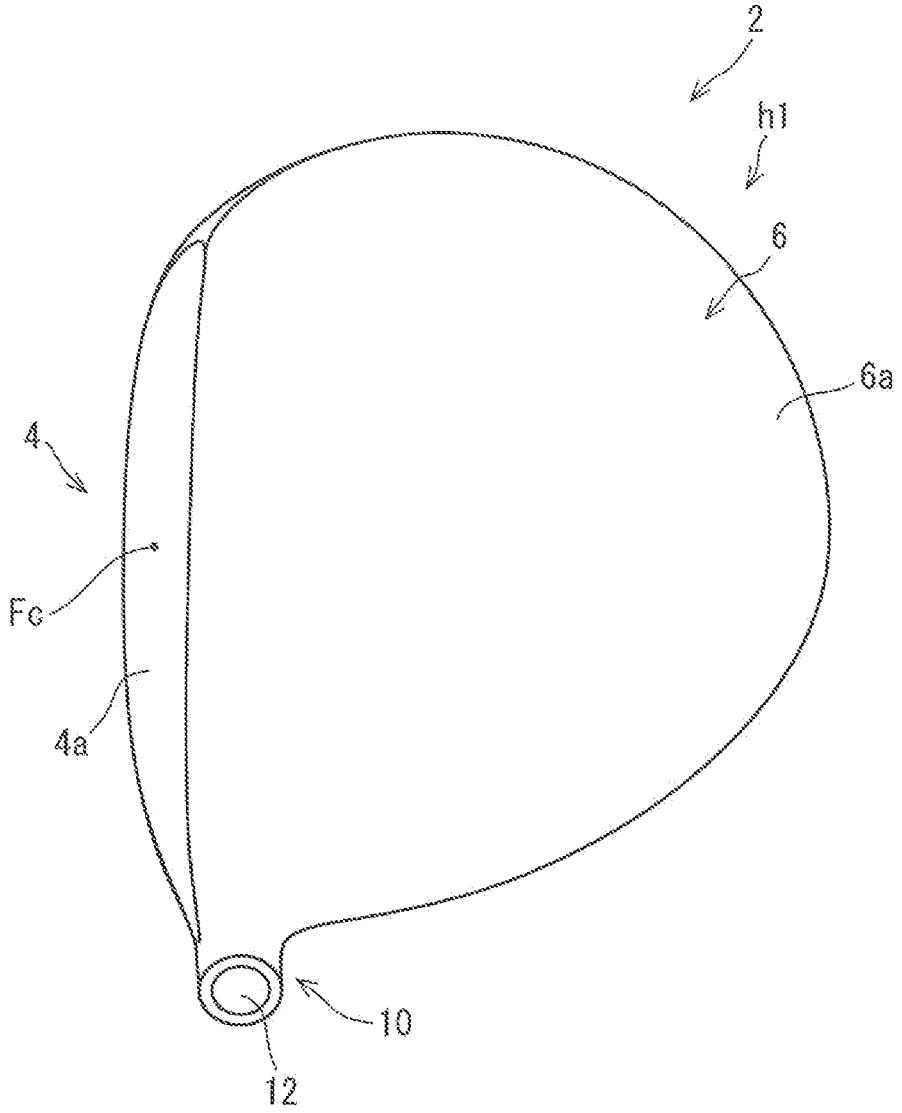
FIG. 1 is a plan view of a head according to a first embodiment.
Figure 2:
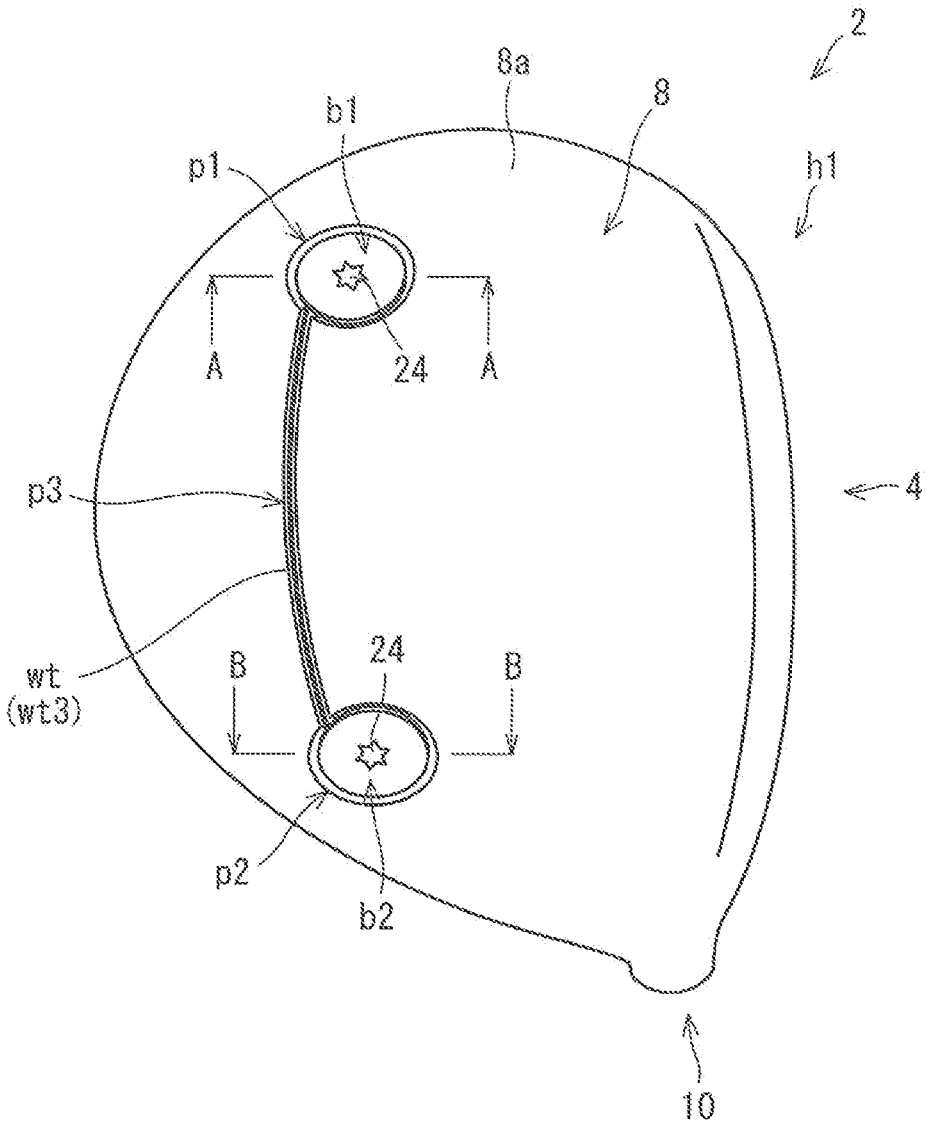
FIG. 2 is a bottom view of the head in FIG. 1.
Figure 3A:
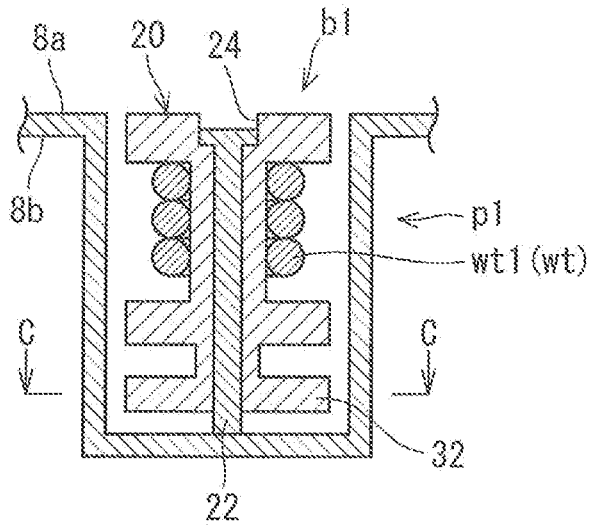
FIG. 3A is a cross sectional view taken along line A-A in FIG. 2.
Figure 3B:
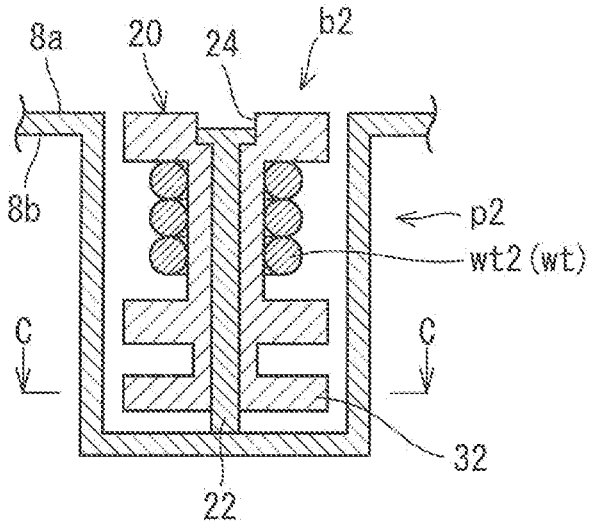
FIG. 3B is a cross sectional view taken along line B-B in FIG. 2.
Figure 3C:
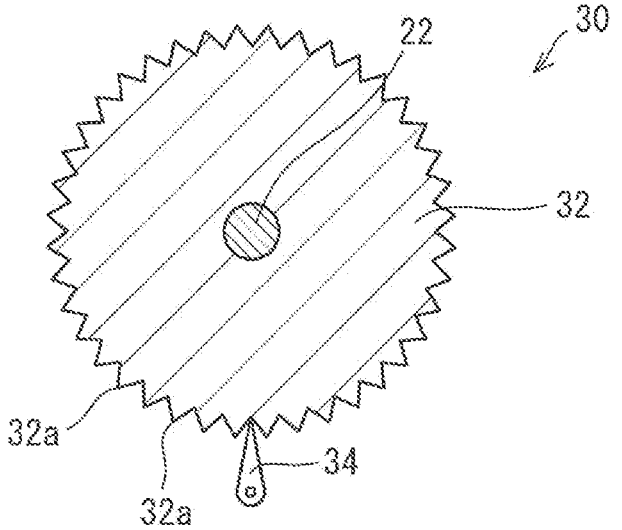
FIG. 3C is a cross-sectional view taken along lines C-C in FIG. 3A and FIG. 3B.

FIG. 1 is a plan view of a golf club head 2 according to a first embodiment as viewed from a crown side. FIG. 2A is a bottom view of the head 2 as viewed from a sole side. FIG. 3A is a cross-sectional view taken along line A-A in FIG. 2. FIG. 3B is a cross-sectional view taken along line B-B in FIG. 2. FIG. 3C is a cross-sectional view taken along lines C-C in FIG. 3A and FIG. 3B.

The head 2 (head body h1) includes a face portion 4, a crown portion 6, a sole portion 8, and a hosel portion 10. The face portion 4 includes a face outer surface 4*a* and a face inner surface 4*b* (not shown in the drawings). The face outer surface 4*a* is a surface for hitting a ball. The face outer surface 4*a* has a face center Fc. The crown portion 6 includes a crown outer surface 6*a* and a crown inner surface (not shown in the drawings). The sole portion 8 includes a sole outer surface 8*a* and a sole inner surface 8*b* (see FIG. 3A). The hosel portion 10 has a hosel hole 12. The head 2 is a wood-type golf club head.

The head 2 includes a first wound portion b1, a second wound portion b2, and a weight member wt. The first wound portion b1 and the second wound portion b2 are attached to the head body h1, and the weight member wt is stretched between the first wound portion b1 and the second wound portion b2. In the present embodiment, the sole portion 8 includes the first wound portion b1 and the second wound portion b2. The first wound portion b1 and the second wound portion b2 are connected to each other by the weight member wt. The first wound portion b1 is provided at a toe-side position with respect to the second wound portion b2. The first wound portion b1 is provided at a toe-side position with respect to the face center Fc. The second wound portion b2 is provided at a heel-side position with respect to the face center Fc.

The weight member wt has a long and thin shape. The length of the weight member wt is set such that the weight member wt can connect the first wound portion b1 and the second wound portion b2, and have a first part wt1 to be wound around the first wound portion b1 or a second part wt2 to be wound around the second wound portion b2. Examples of the shape of the weight member wt include a wire shape and a belt shape. Examples of the wire-shaped weight member wt include a string, a piece of wire, a metal wire, and wire. The wire is a concept that includes a piece of wire and a wire rope obtained by twisting wires together. The weight member wt may be a chain, for example. The material of the weight member wt is not limited. The weight member wt preferably has a large specific gravity. From the viewpoint of specific gravity and easy winding, a resin containing metal and metal powder is preferable as the material of the weight member wt. Specific examples of the material of the weight member wt include stainless steel, a tungsten nickel alloy, a resin material containing stainless steel, and a resin material containing a tungsten nickel alloy.

In a single weight member wt, its weight per unit length may be constant or may vary.

As shown in FIG. 3A, the first wound portion b1 includes a reel portion 20 and a center shaft 22. The reel portion 20 constitutes a reel (spool). The reel portion 20 is fixed to the center shaft 22. The reel portion 20 can rotate about the center shaft 22. The weight member wt is wound around the first wound portion b1 (reel portion 20). Of the weight member wt, a portion that is wound around the first wound portion b1 is referred to as the first part wt1. The length (length in the longitudinal direction) of the first part wt1 varies depending on how much the weight member wt is wound around the first wound portion b1. The weight of the first part wt1 varies depending on how much the weight member wt is wound around the first wound portion b1.

The first wound portion b1 has an engaging hole 24. The engaging hole 24 is shaped so as to engage with the tip portion of a tool that is used to rotate the first wound portion b1. The tool is a screw driver, for example. The first wound portion b1 can be rotated by this tool.

The first wound portion b1 can rotate in a reel-in direction and a reel-out direction. When the first wound portion b1 rotates in the reel-in direction, the weight member wt is wound around the first wound portion b1, and the length of the first part wt1 increases. When the first wound portion b1 rotates in the reel-out direction, the weight member wt is unwound from the first wound portion b1, and the length of the first part wt1 decreases.

The configuration of the second wound portion b2 is the same as that of the first wound portion b1. As shown in FIG. 3B, the second wound portion b2 includes a reel portion 20 and a center shaft 22. The reel portion 20 constitutes a reel (spool). The reel portion 20 is fixed to the center shaft 22. The reel portion 20 can rotate about the center shaft 22. The weight member wt is wound around the second wound portion b2 (reel portion 20). Of the weight member wt, a portion that is wound around the second wound portion b2 is referred to as the second part wt2. The length (length in the longitudinal direction) of the second part wt2 varies depending on how much the weight member wt is wound around the second wound portion b2. The weight of the second part wt2 varies depending on how much the weight member wt is wound around the second wound portion b2.

The second wound portion b2 can rotate in the reel-in direction and the reel-out direction. When the second wound portion b2 rotates in the reel-in direction, the weight member wt is wound around the second wound portion b2, and the length of the second part wt2 increases. When the second wound portion b2 rotates in the reel-out direction, the weight member wt is unwound from the second wound portion b2, and the length of the second part wt2 decreases.

The rotation of the first wound portion b1 and the rotation of the second wound portion b2 can be linked together by the weight member wt. When a rotation force is applied to the first wound portion b1 to rotate the first wound portion b1 in the reel-in direction, this rotation can involve the rotation of the second wound portion b2 in the reel-out direction. When a rotation force is applied to the second wound portion b2 to rotate the second wound portion b2 in the reel-in direction, this rotation can involve the rotation of the first wound portion b1 in the reel-out direction. This linkage provides easier adjustability of the position of the center of gravity of the head.

The weight member wt includes a third part wt3. The third part wt3 is a portion that is not wound around any wound portion b1 or b2. In the present embodiment, the third part wt3 is a part located between the first part wt1 and the second part wt2.

When the third part wt3 is pulled by the first wound portion b1 and the second wound portion b2, a tension can be applied to the third part wt3. When the tension is applied to the third part wt3, the length of the third part wt3 is substantially constant. When the tension is not applied to the third part wt3, the third part wt3 might go slack.

The second wound portion b2 has an engaging hole 24. The engaging hole 24 is shaped so as to engage with the tip portion of a tool that is used to rotate the second wound portion b2. The tool is a screw driver, for example. This tool can be also used as the tool for rotating the first wound portion b1.

As shown in FIG. 3C, the first wound portion b1 includes a rotation resistance mechanism 30. The rotation resistance mechanism 30 includes a rotary gear 32 and a gear engaging portion 34. The rotary gear 32 is fixed to the center shaft 22 and rotates together with the reel portion 20. The gear engaging portion 34 engages with teeth 32*a* of the rotary gear 32. This engagement prevents the rotation of the rotary gear 32. When the rotary gear 32 is about to rotate, the rotary gear 32 applies a stress on the gear engaging portion 34. The gear engaging portion 34 is elastically deformed by the stress applied from the rotary gear 32. When the magnitude of the stress from the rotary gear 32 exceeds a predetermined value, the degree of the elastic deformation of the gear engaging portion 34 increases, and the gear engaging portion 34 gets over one of the teeth 32*a*. By repeating the elastic deformation, the rotary gear 32 rotates while receiving the rotational resistance. The rotation resistance mechanism 30 applies a same magnitude of resistance force to the rotation of the rotary gear 32 in the reel-in direction and the rotation of the rotary gear 32 in the reel-out direction.

The second wound portion b2 also includes the same rotation resistance mechanism 30 as in the first wound portion b1.

When the first wound portion b1 is rotated in the reel-in direction, the weight of the first part wt1 increases and the weight of the second part wt2 decreases. That is, the weight of the weight member wt is distributed largely to the first part wt1. As a result, the position of the center of gravity of the head 2 is shifted toward the first wound portion b1. In the present embodiment, the position of the center of gravity of the head 2 is shifted toward the toe side.

When the second wound portion b2 is rotated in the reel-in direction, the weight of the second part wt2 increases and the weight of the first part wt1 decreases. That is, the weight of the weight member wt is distributed largely to the second part wt2. As a result, the position of the center of gravity of the head 2 is shifted toward the second wound portion b2. In the present embodiment, the position of the center of gravity of the head 2 is shifted to the heel side.

The rotation resistance mechanism 30 contributes to keeping the tension applied to the third part wt3.

The head 2 includes a first port p1 and a second port p2. The head body h1 of the head 2 includes the first port p1 and the second port p2. In the present embodiment, the first port p1 and the second port p2 are provided in the sole portion 8. As shown in FIG. 3A, the first port p1 houses the first wound portion b1. The first wound portion b1 does not protrude further outward of the head 2 than the sole outer surface 8*a*. As shown in FIG. 3B, the second port p2 houses the second wound portion b2. The second wound portion b2 does not protrude further outward of the head 2 than the sole outer surface 8*a*.

The head 2 has a housing recess p3. The housing recess p3 extends from the first port p1 to the second port p2. The housing recess p3 constitutes a groove. The housing recess p3 houses the third part wt3. As long as the tension is applied to the third part wt3, the third part wt3 is housed in the housing recess p3. Since the third part wt3 is housed in the housing recess p3, the third part wt3 is disposed inside the sole outer surface 8*a*.

Figure 4A:
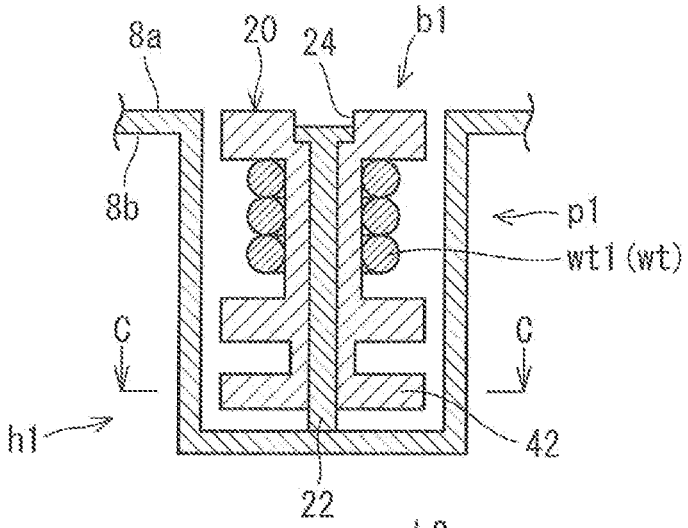
FIG. 4A is a cross-sectional view of a first wound portion b1 and its vicinity according to a first modification example.
Figure 4B:
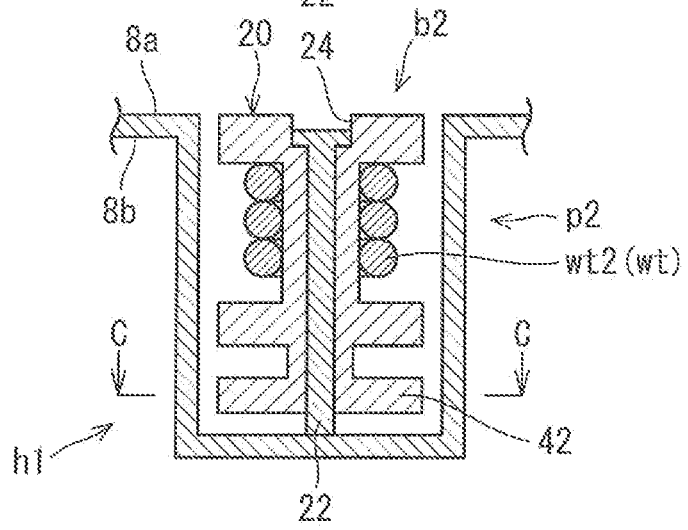
FIG. 4B is a cross-sectional view of a second wound portion b2 and its vicinity according to the first modification example.
Figure 4C:
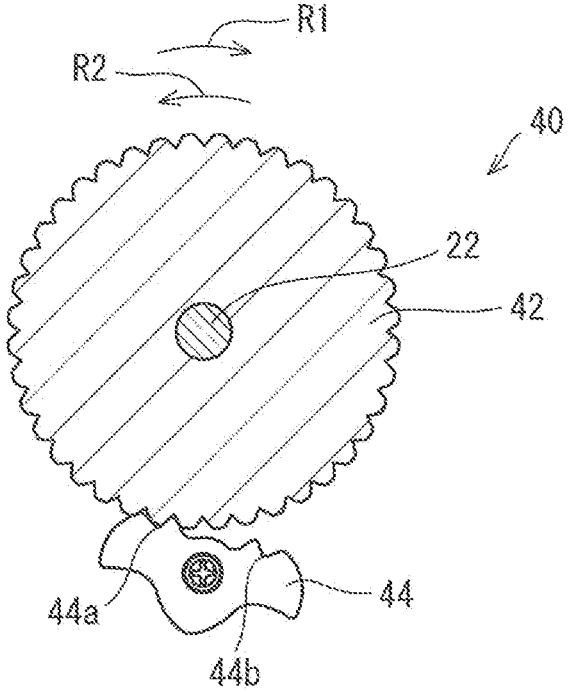
FIG. 4C is a cross-sectional view taken along lines C-C in FIG. 4A and FIG. 4B.

FIG. 4A is an enlarged cross-sectional view showing a first wound portion b1 and its vicinity according to a first modification example, and FIG. 4B is an enlarged cross-sectional view showing a second wound portion b2 and its vicinity according to the first modification example. FIG. 4C is a cross-sectional view taken along lines C-C in FIG. 4A and FIG. 4B. A head of the first modification example is the same as the head 2 of the first embodiment except for structures described below.

In the first modification example, a ratchet mechanism 40 is provided instead of the rotation resistance mechanism 30. The first wound portion b1 and the second wound portion b2 each have the ratchet mechanism 40.

The ratchet mechanism 40 includes a rotary gear 42 and a gear engaging portion 44. The rotary gear 42 rotates together with the reel portion 20. The gear engaging portion 44 constitutes a switching cam. The gear engaging portion 44 includes a first engaging portion 44*a* and a second engaging portion 44*b*. The gear engaging portion 44 is structured such that mutual transition (switching) between a first state in which the first engaging portion 44*a* engages with the rotary gear 42 and a second state in which the second engaging portion 44*b* engages with the rotary gear 42 can be performed. That is, the gear engaging portion 44 can switch between the first state and the second state. FIG. 4C shows the first state. The first state allows the rotary gear 42 to rotate in a first direction R1, and prevents the rotary gear 42 from rotating in a second direction R2. The second state allows the rotary gear 42 to rotate in the second direction R2, and prevents the rotary gear 42 from rotating in the first direction R1. The first direction R1 is the reel-in direction, and the second direction R2 is the reel-out direction. This ratchet mechanism can change the rotation direction between the reel-in direction and the reel-out direction. The ratchet mechanism is used, for example, in a ratchet handle for fastening a nut and a bolt.

For rotating the first wound portion b1 in the reel-in direction, the first wound portion b1 is set to the first state, the second wound portion b2 is set to the second state, and then the first wound portion b1 is rotated in the reel-in direction. For rotating the second wound portion b2 in the reel-in direction, the second wound portion b2 is set to the first state, the first wound portion b1 is set to the second state, and then the second wound portion b2 is rotated in the reel-in direction. The slack of the third part wt3 can be taken up by setting both the first wound portion b1 and the second wound portion b2 to the first state, and rotating the first wound portion b1 or the second wound portion b2 in the reel-in direction.

Figure 5A:
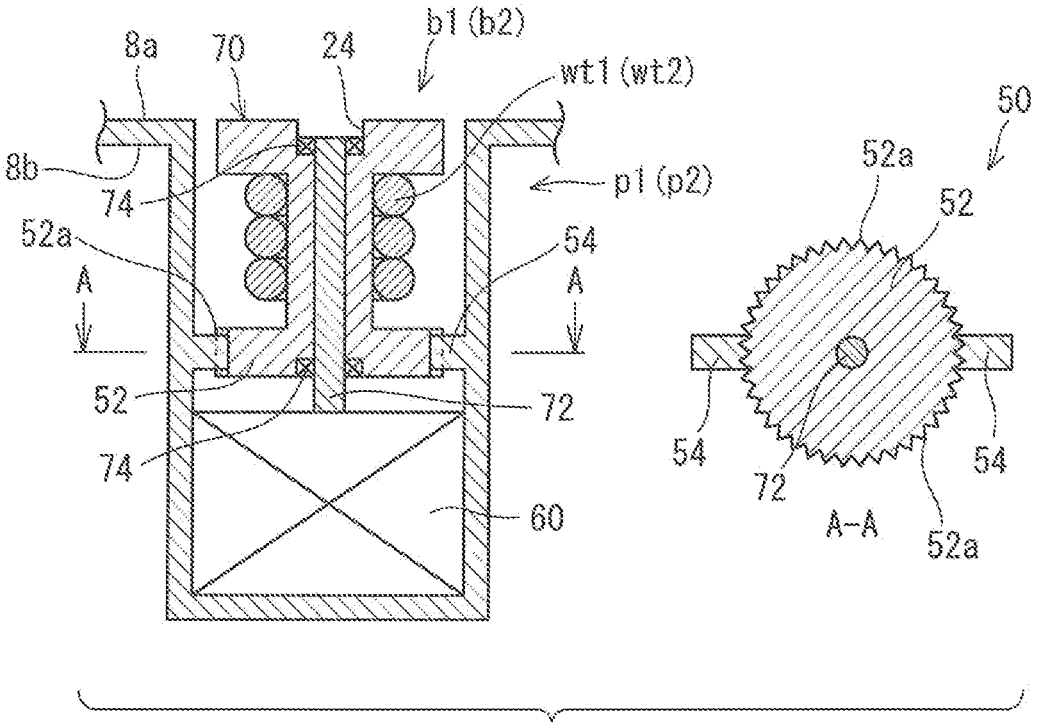
FIG. 5A and FIG. 5B are cross-sectional views of a first wound portion b1, a second wound portion b2 and their vicinity according to a second modification example, and also shows cross-sectional views taken along line A-A and line B-B, the first wound portion b1 (second wound portion b2) in FIG. 5A being situated at a pushed-in position, and the first wound portion b1 (second wound portion b2) in FIG. 5B being situated at a projecting position.
Figure 5B:
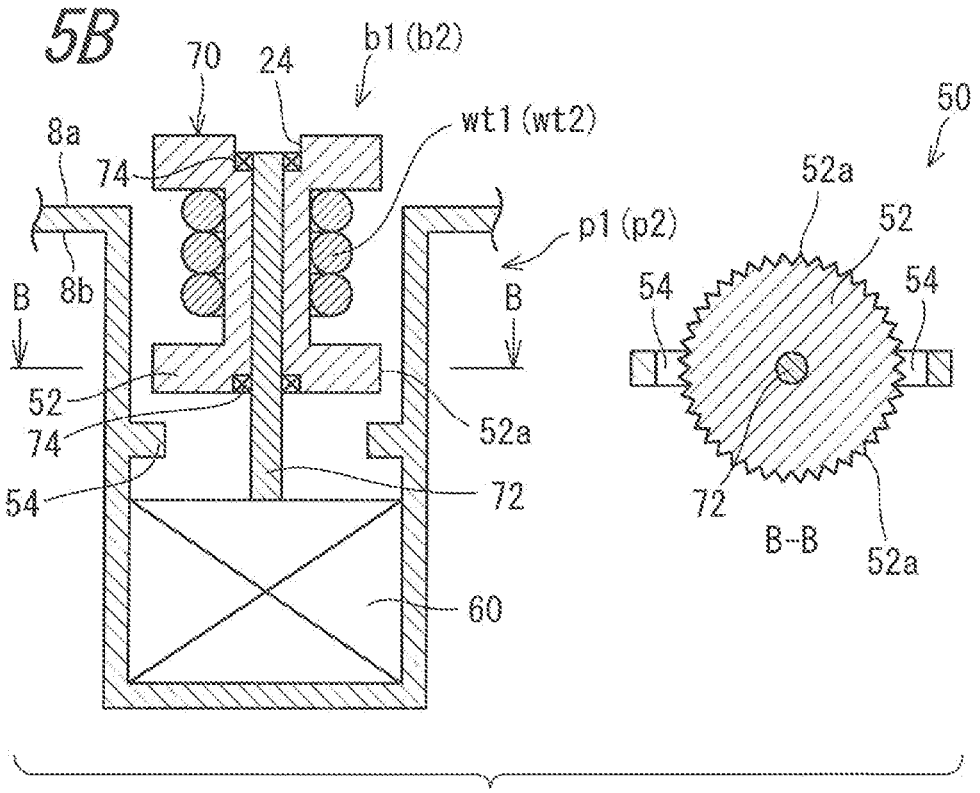

FIG. 5A and FIG. 5B are enlarged cross-sectional views each showing a first wound portion b1 and its vicinity according to a second modification example. In FIG. 5A, the first wound portion b1 is situated at a pushed-in position. At the pushed-in position, the first wound portion b1 is housed in a first port p1. FIG. 5A also shows a cross-sectional view taken along line A-A. In FIG. 5B, the first wound portion b1 is situated at a projecting position. FIG. 5B also shows a cross-sectional view taken along line B-B.

In this second modification example, the configuration of the second wound portion b2 is the same as that of the first wound portion b1. FIG. 5A and FIG. 5B also show enlarged sectional views of the second wound portion b2 and its vicinity in the second modification example.

In the second modification example, a rotation prevention mechanism 50 and an alternate mechanism 60 are provided instead of the rotation resistance mechanism 30. In addition, in this modification example, a reel portion 70 is provided instead of the reel portion 20. The first wound portion b1 includes the rotation prevention mechanism 50, the alternate mechanism 60, and the reel portion 70. The second wound portion b2 includes the rotation prevention mechanism 50, the alternate mechanism 60, and the reel portion 70. The head of the second modification example is the same as the head 2 of the first embodiment except for structures described below.

The reel portion 70 is not fixed to a rotation supporting shaft 72. The reel portion 70 is rotatably supported by the rotation supporting shaft 72. The reel portion 70 can rotate with respect to the rotation supporting shaft 72. The reel portion 70 is fixed to the rotation supporting shaft 72 through a bearing 74.

The rotation prevention mechanism 50 includes a rotary gear 52 and a gear engaging portion 54. The gear engaging portion 54 constitutes a rotation preventing portion that engages with teeth 52*a* of the rotary gear 52 to prevent the rotation of the rotary gear 52. The rotary gear 52 is provided in the reel portion 70.

As shown in FIG. 5A, when the first wound portion b1 is situated at the pushed-in position, the rotary gear 52 engages with the gear engaging portion 54, which prevents the rotation of the first wound portion b1. As shown in FIG. 5B, when the first wound portion b1 is situated at the projecting position, the rotary gear 52 does not engage with the gear engaging portion 54, which allows the rotation of the first wound portion b1.

When the first wound portion b1 situated at the pushed-in position is pushed, the first wound portion b1 is shifted to the projecting position, and the first wound portion b1 stays at the projecting position even after stopping pushing the first wound portion b1. When the first wound portion b1 situated at the projecting position is pushed, the first wound portion b1 is shifted to the pushed-in position, and the first wound portion b1 stays at the pushed-in position even after stopping pushing the first wound portion b1. Such an action (motion) of the first wound portion b1 is also referred to as an alternate action. The alternate mechanism 60 enables the first wound portion b1 to perform the alternate action. The alternate mechanism 60 is configured such that a mutual transition (switching) between the pushed-in position and the projecting position can be performed. The first wound portion b1 situated at the pushed-in position does not protrude further outward than the sole outer surface 8*a*. The first wound portion b1 situated at the projecting position protrudes further outward than the sole outer surface 8*a*.

The pushing of the first wound portion b1 can be achieved by pushing the first wound portion b1 with a finger, for example. The mutual transition of the first wound portion b1 between the pushed-in position and the projecting position can be achieved by simply pushing the first wound portion b1 with a finger. Every time the first wound portion b1 is pushed, the switching of the first wound portion b1 between the pushed-in position and the projecting position is performed.

Figure 6:
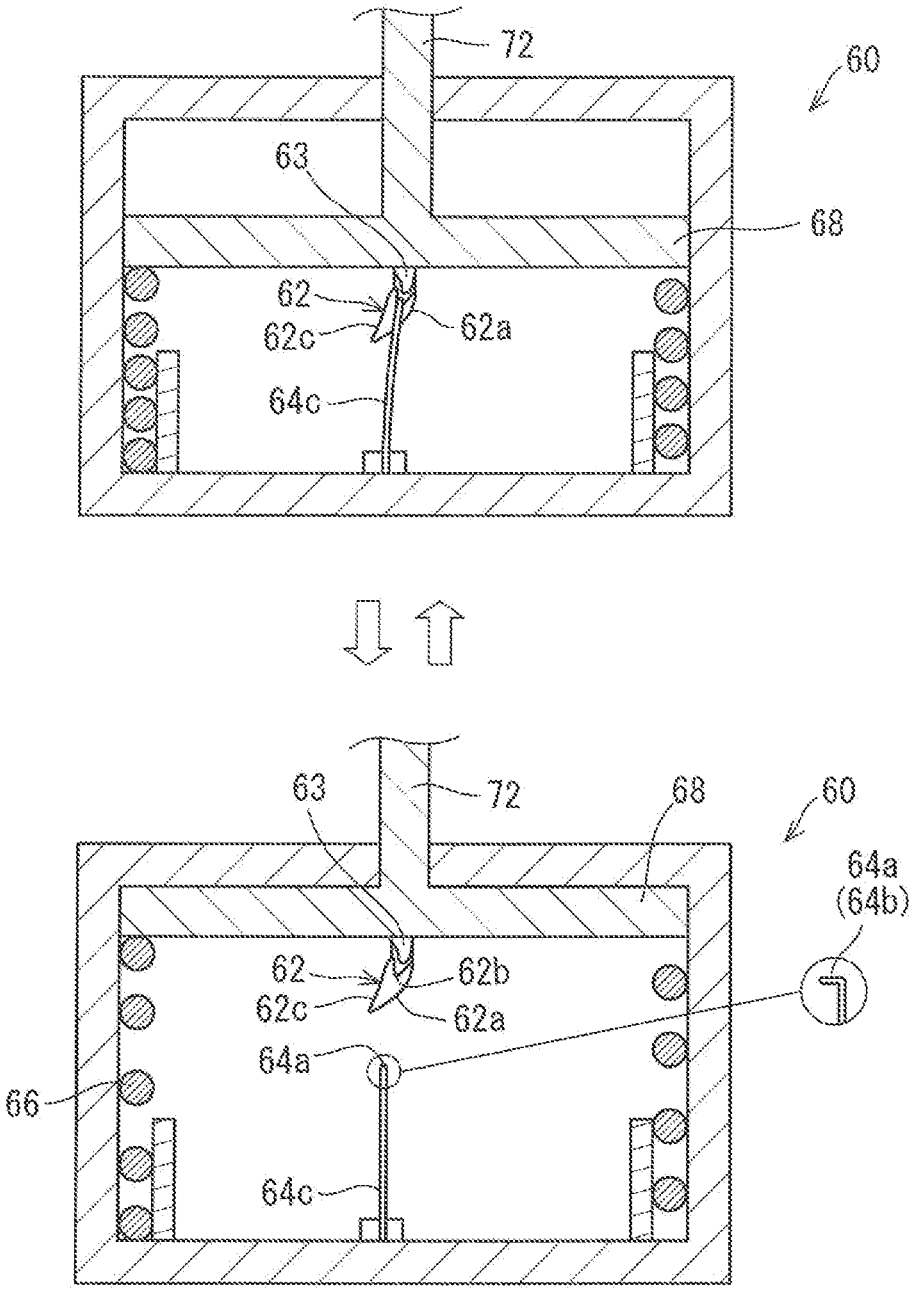
FIG. 6 is a cross-sectional view showing an alternate mechanism according to the second modification example.

FIG. 6 shows a cross-sectional view of the alternate mechanism 60. An upper part in FIG. 6 shows a cross-sectional view when the first wound portion b1 (second wound portion b2) is situated at the pushed-in position. A lower part in FIG. 6 is a cross-sectional view when the first wound portion b1 (second wound portion b2) is situated at the projecting position.

The alternate mechanism 60 includes a heart-shaped cam 62, a pin 64, a biasing member 66, and a moving portion 68. The cam 62 is fixed to the moving portion 68. The pin 64 is made of a metal and a rod-shaped member.

The pin 64 is fixed in a cantilever state in which an end portion (lower end portion in FIG. 6) of the pin 64 on a farther side from the cam 62 is supported. An end portion 64*a* (upper end portion in FIG. 6) of the pin 64 on a closer side to the cam 62 is a free end. The free end 64*a* is provided with an engaging portion 64*b* that engages with the cam 62. A drawing within a circle in FIG. 6 shows the free end 64*a* as viewed from another angle, and also shows the engaging portion 64*b*. An angled end portion 64*a* of the pin 64 forms the engaging portion 64*b*. When a main portion 64*c* of the pin 64 is bent by an external force, the main portion 64*c* of the pin 64 tends to return to a natural state (a straightly extending state).

The biasing member 66 is a compression coil spring. The biasing member 66 biases the moving portion 68 upward at all times. The biasing member 66 biases the moving portion 68 at all times in a direction in which the cam 62 moves away from the pin 64.

The rotation supporting shaft 72 is fixed to the moving portion 68. The first wound portion b1 moves in conjunction with the movement of the moving portion 68. The first wound portion b1 moves together with the moving portion 68.

The cam 62 includes a first guide surface 62*a*, a recess 62*b*, and a second guide surface 62*c*. A pin guiding portion 63 is provided in the vicinity of the cam 62.

When the pin 64 engages with the cam 62, the first wound portion b1 stays at the pushed-in position while resisting the biasing force of the biasing member 66 (see upper part of FIG. 6). When the engagement between the pin 64 and the cam 62 is released, the first wound portion b1 is shifted to the projecting position because of the biasing force of the biasing member 66 (see lower part of FIG. 6).

When the first wound portion b1 situated at the projecting position is pushed, the cam 62 located apart from the pin 64 comes closer to the pin 64. The engaging portion 64*b* of the pin 64 abuts on the first guide surface 62*a* of the cam 62, is guided by the first guide surface 62*a*, and is also guided by the pin guiding portion 63 to reach the recess 62*b*. The engaging portion 64*b* engages with the recess 62*b*, whereby the first wound portion b1 is shifted to and kept at the pushed-in position (see upper part of FIG. 6).

When the first wound portion b1 situated at the pushed-in position is pushed, the engaging portion 64*b* comes off the recess 62*b* since the pin 64 tends to return to its natural state from elastically deformed state, moves along the second guide surface 62*c*, and moves away from the cam 62. As a result, the first wound portion b1 returns to the projecting position.

As described above, in the present embodiment, the heart-shaped cam mechanism is adopted as the alternate mechanism 60. Examples of the alternate mechanism 60 include known mechanisms such as a rotary cam mechanism and a ratchet cam mechanism in addition to a heart-shaped cam mechanism.

Figure 7:
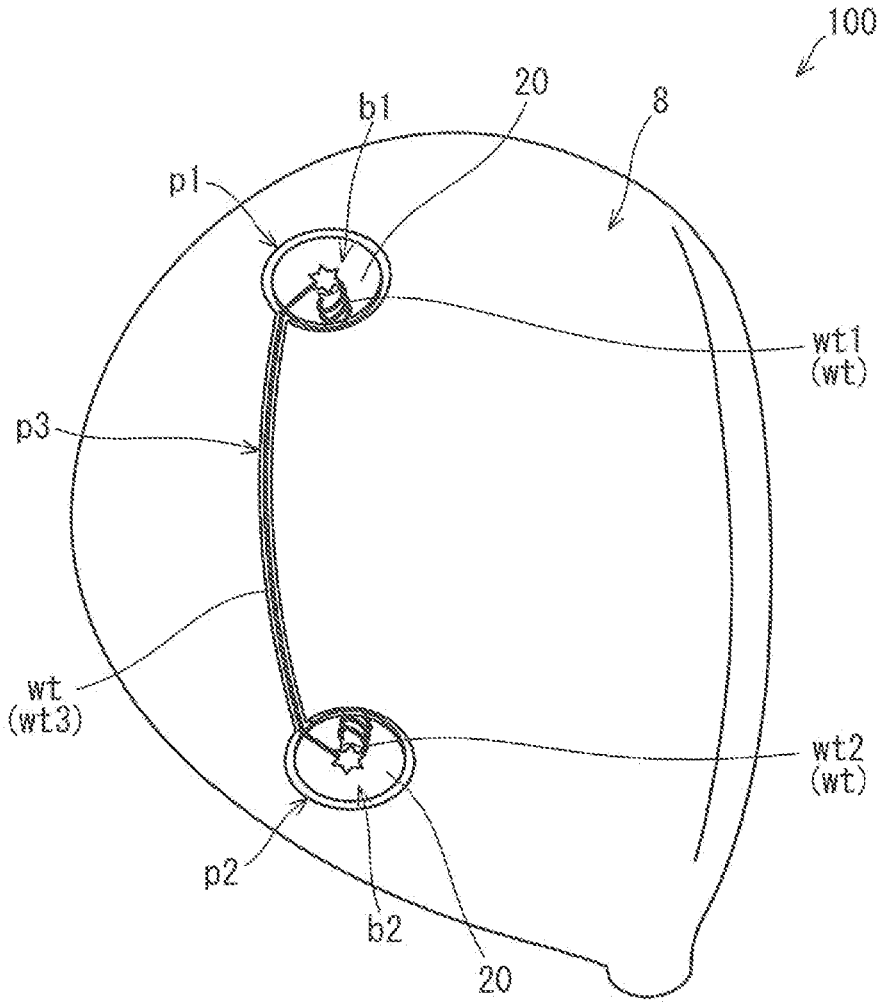
FIG. 7 is a bottom view of a head according to a second embodiment.

FIG. 7 is a bottom view of a head 100 according to a second embodiment as viewed from the sole side. In the head 100, each reel portion 20 of a first wound portion b1 and a second wound portion b2 has transparency. In the head 100, a first part wt1 that is wound around the first wound portion b1 is visually recognized from the outside of the head 100. In the head 100, a second part wt2 that is wound around the second wound portion b2 can be visually recognized from the outside of the head 100. Except for the above-described structures, the head 100 is the same as the head 2. The head 100 does not have a first wound portion b1 or a second wound portion b2 in the crown portion.

Figure 8:
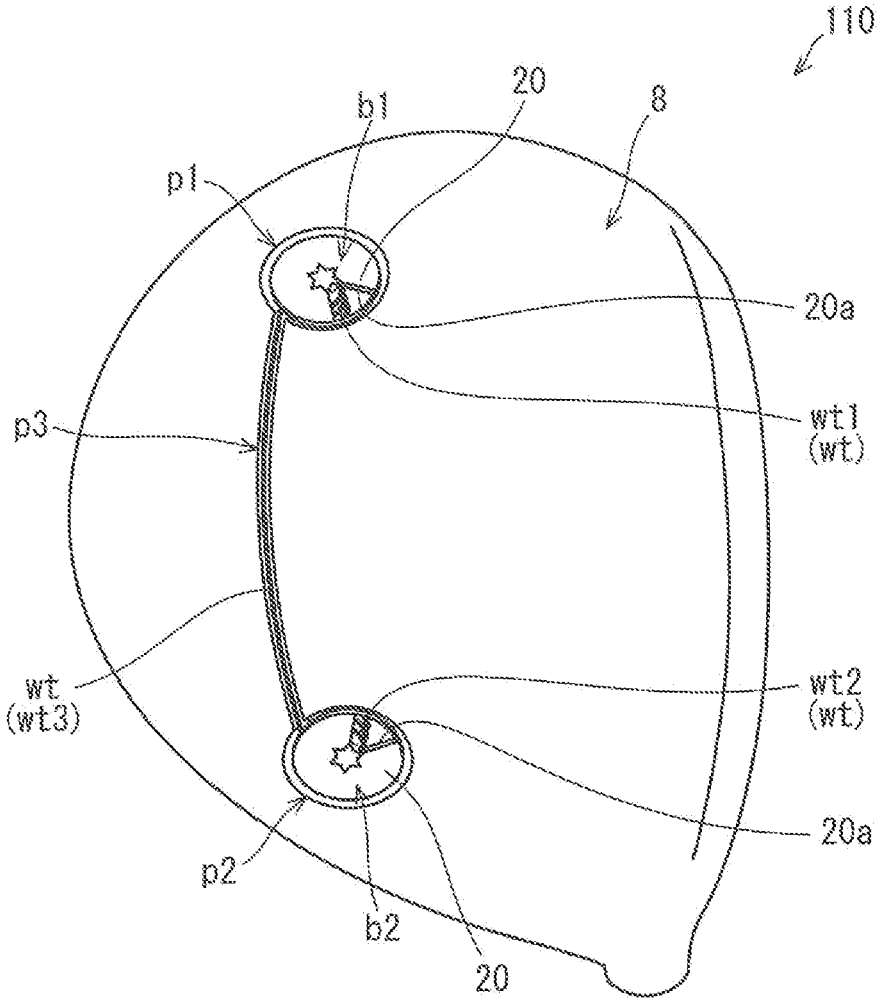
FIG. 8 is a bottom view of a head according to a third embodiment.

FIG. 8 is a bottom view of a head 110 according to a third embodiment as viewed from the sole side. In the head 110, a notch 20*a* is provided in each reel portion 20 of a first wound portion b1 and a second wound portion b2. A first part wt1 that is wound around the first wound portion b1 is visually recognized from the outside of the head 110 through the notch 20*a*. A second part wt2 that is wound around the second wound portion b2 can be visually recognized from the outside of the head 110 through the notch 20*a*. Except for the above-described structures, the head 110 is the same as the head 2. The head 110 does not have a first wound portion b1 or a second wound portion b2 in the crown portion.

Figure 9:
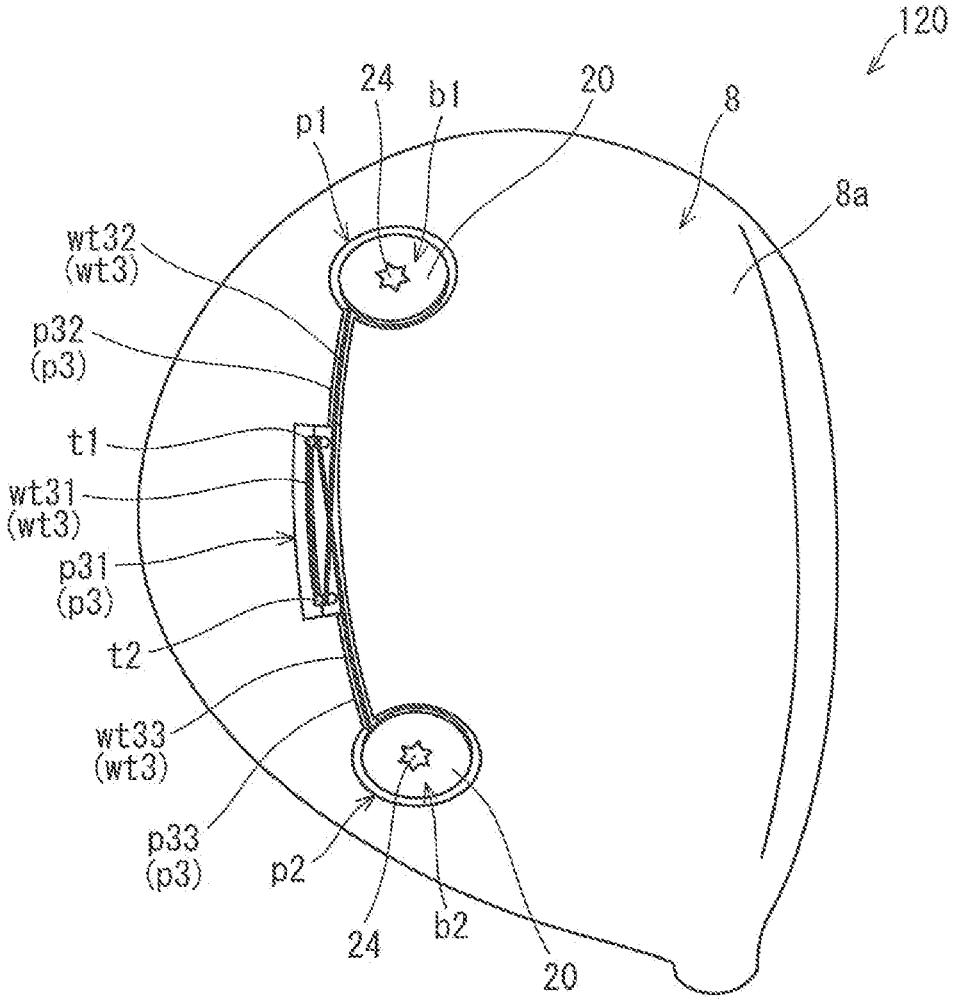
FIG. 9 is a bottom view of a head according to a fourth embodiment.

FIG. 9 is a bottom view of a head 120 according to a fourth embodiment as viewed from the sole side. The head 120 (sole portion 8) includes a first wound portion b1, a first port p1 that houses the first wound portion b1, a second wound portion b2, and a second port p2 that houses the second wound portion b2. The head 120 (sole portion 8) further includes a projection t1 and a projection t2. The projection t1 and the projection t2 are disposed on the heel side with respect to the first wound portion b1. The projection t1 and the projection t2 are disposed on the toe side with respect to the second wound portion b2. The projection t1 and the projection t2 are erected columns. The number of the projections may be one, but is preferably two or more.

A weight member wt can be wound around the projection t1. The weight member wt can be wound around the projection t2. Each of the projection t1 and the projection t2 is relatively thin. Accordingly, when the weight member wt is wound around each of the projection t1 and the projection t2, the length of a portion wound around the projection(s) is not efficiently increased. As shown in FIG. 9, in the present embodiment, the weight member wt is wound around the projection t1 and the projection t2 so as to be stretched from the projection t1 to the projection t2. By winding the weight member wt in this manner, the length of a part (hereinafter referred to as a projection wound portion wt31) of the weight member wt that is wound around the projection t1 and the projection t2 can be increased. The weight member wt can be wound in various forms.

In the head 120 (the sole portion 8), the weight member wt includes a first part (not shown) that is wound around the first wound portion b1, a second part (not shown) that is wound around the second wound portion b2, and a third part wt3 that is a portion other than the first part or the second part. The third part wt3 includes the projection wound portion wt31 wound around the projections t1 and t2, an extension portion wt32 that extends from the projection wound portion wt31 to the first wound portion b1 (first part wt1), and an extension portion wt33 that extends from the projection wound portion wt31 to the second wound portion b2 (second part wt2).

A housing recess p3 houses (the entirety of) the third part wt3. The housing recess p3 includes a first recess p31 that houses the projection t1, the projection t2 and the projection wound portion wt31, a second recess p32 that houses the extension portion wt32, and a third recess p33 that houses the extension portion wt33. Neither the projection t1 nor the projection t2 protrudes further outward than the sole outer surface 8*a*. The third part wt3 does not protrude further outward than the sole outer surface 8*a*.

Except for the above-described structures, the head 120 is the same as the head 2. The head 120 does not have a first wound portion b1 or a second wound portion b2 in the crown portion.

Figure 10:
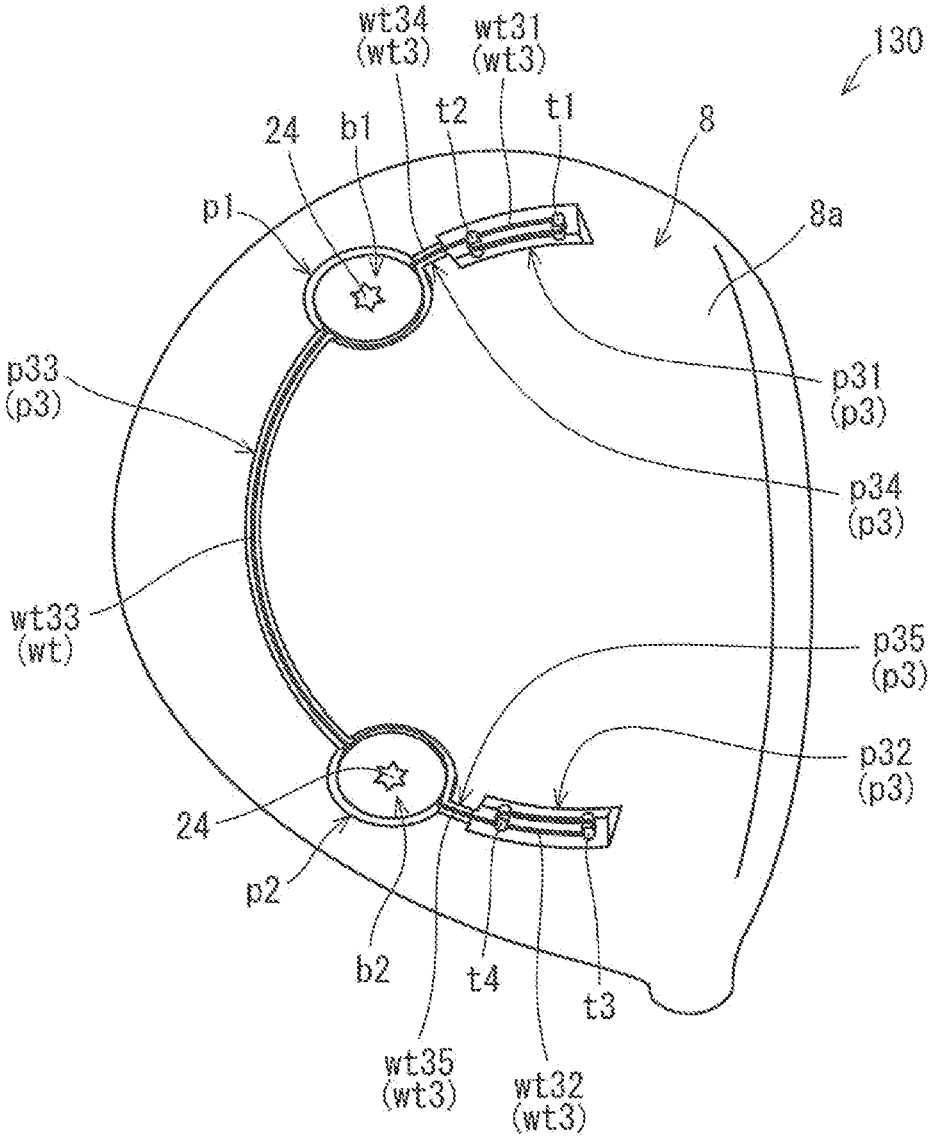
FIG. 10 is a bottom view of a head according to a fifth embodiment.

FIG. 10 is a bottom view of a head 130 according to a fifth embodiment as viewed from the sole side. The head 130 (sole portion 8) includes a first wound portion b1, a first port p1 that houses the first wound portion b1, a second wound portion b2, and a second port p2 that houses the second wound portion b2. The head 130 (sole portion 8) further includes a projection t1, a projection t2, a projection t3, and a projection t4. The projection t1 and the projection t2 are disposed on the toe side with respect to the projection t3 and the projection t4. The projection t1 and the projection t2 are disposed on the face side of the first wound portion b1. The projection t3 and the projection t4 are disposed on the face side of the second wound portion b2.

In the head 130 (sole portion 8), the weight member wt includes a first part (not shown) that is wound around the first wound portion b1, a second part (not shown) that is wound around the second wound portion b2, and a third part wt3 that is a portion other than the first part or the second part. The third part wt3 includes a projection wound portion wt31 that is wound around the projections t1 and t2, a projection wound portion wt32 that is wound around the projections t3 and t4, and an extension portion wt33 that extends from the first wound portion b1 (first part wt1) to the second wound portion b2 (second part wt2). The third part wt3 further includes an extension portion wt34 that extends from the projections t1 and t2 to the first wound portion b1, and an extension portion wt35 that extends from the projections t3 and t4 to the second wound portion b2.

A housing recess p3 houses (the entirety of) the third part wt3. The housing recess p3 includes: a first recess p31 that houses the projection t1, the projection t2 and the projection wound portion wt31; a second recess p32 that houses the projection t3, the projection t4, and the projection wound portion wt32; and a third recess p33 that houses the extension portion wt33. The housing recess p3 further includes a fourth recess p34 that houses the extension portion wt34, and a fifth recess p35 that houses the extension portion wt35.

Neither the projection t1 nor the projection t2 protrudes further outward than the sole outer surface 8*a*. Neither the projection t3 nor the projection t4 protrudes further outward than the sole outer surface 8*a*. The third part wt3 does not protrude further outward than the sole outer surface 8*a*.

Except for the above-described structures, the head 130 is the same as the head 2. The head 130 does not have a first wound portion b1 or a second wound portion b2 in the crown portion.

Figure 11:
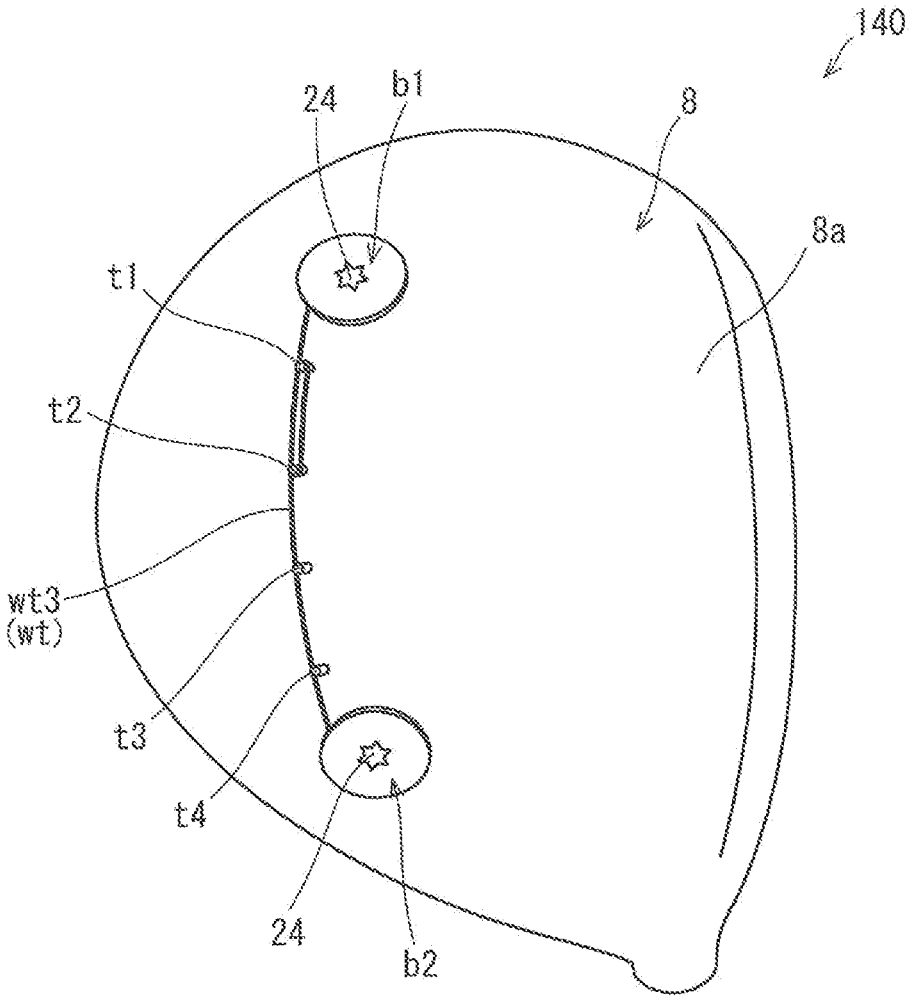
FIG. 11 is a bottom view of a head according to a sixth embodiment.

FIG. 11 is a bottom view of a head 140 according to a sixth embodiment as viewed from the sole side. The head 140 (sole portion 8) includes a first wound portion b1 and a second wound portion b2. The head 140 (sole portion 8) does not have a first port p1. The first wound portion b1 is exposed to the outside of the sole outer surface 8*a*. The head 140 (sole portion 8) does not have a second port p2. The second wound portion b2 is exposed to the outside of the sole outer surface 8*a*.

The head 140 (sole portion 8) includes a projection t1, a projection t2, a projection t3, and a projection t4. The projection t1, the projection t2, the projection t3, and the projection t4 are disposed on the heel side with respect to the first wound portion b1. The projection t1, the projection t2, the projection t3, and the projection t4 are disposed on the toe side with respect to the second wound portion b2.

The head 140 (sole portion 8) does not have a housing recess p3 that houses a third part wt3. The third part wt3 protrudes further outward than the sole outer surface 8*a*. The projection t1, the projection t2, the projection t3, and the projection t4 protrude further outward than the sole outer surface 8*a*.

The third part wt3 can be wound around at least one of the projection t1, the projection t2, the projection t3, or the projection t4 at a position located between the first wound portion b1 (first part wt1) and the second wound portion b2 (second part wt2). The third part wt3 may be wound so as to be stretched between two or more projections selected from the group consisting of the projection t1, the projection t2, the projection t3, and the projection t4. The third part wt3 can be wound in various forms using the plurality of projections.

Except for the above-described structures, the head 140 is the same as the head 2. The head 140 does not have a first wound portion b1 or a second wound portion b2 in the crown portion.

Figure 12:
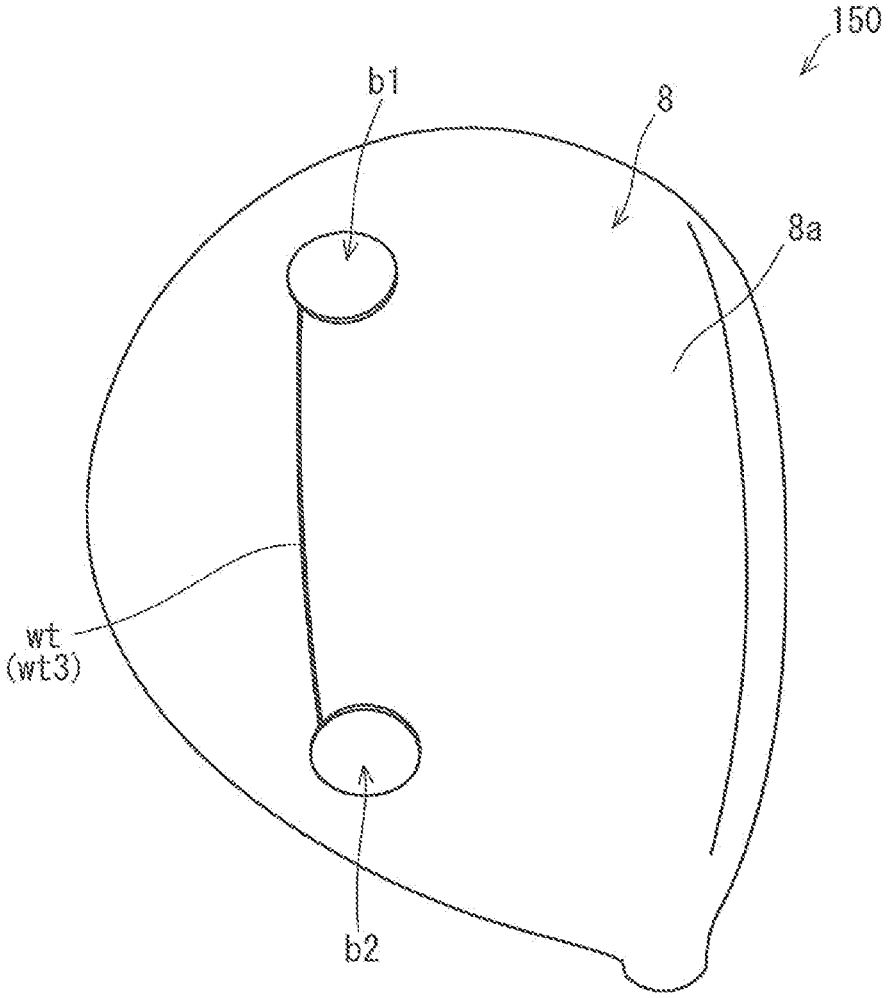
FIG. 12 is a bottom view of a head according to a seventh embodiment.

FIG. 12 is a bottom view of a head 150 according to a seventh embodiment as viewed from the sole side. The head 150 (sole portion 8) includes a first wound portion b1 and a second wound portion b2. The head 150 (sole portion 8) does not have a first port p1. The first wound portion b1 is exposed to the outside of the sole outer surface 8*a*. The head 150 (sole portion 8) does not have the second port p2. The second wound portion b2 is exposed to the outside of the sole outer surface 8*a*. The head 150 (sole portion 8) does not have a housing recess p3. A weight member wt (third part wt3) that extends from the first wound portion b1 to the second wound portion b2 protrudes further outward than the sole outer surface 8*a*. The head 150 (sole portion 8) does not have a projection around which the weight member wt can be wound. Neither the first wound portion b1 nor the second wound portion b2 includes the engaging hole 24. The first wound portion b1 and the second wound portion b2 are non-rotatable. For example, the weight member wt can be wound around the first wound portion b1 and the second wound portion b2 with fingers.

Figure 13A:
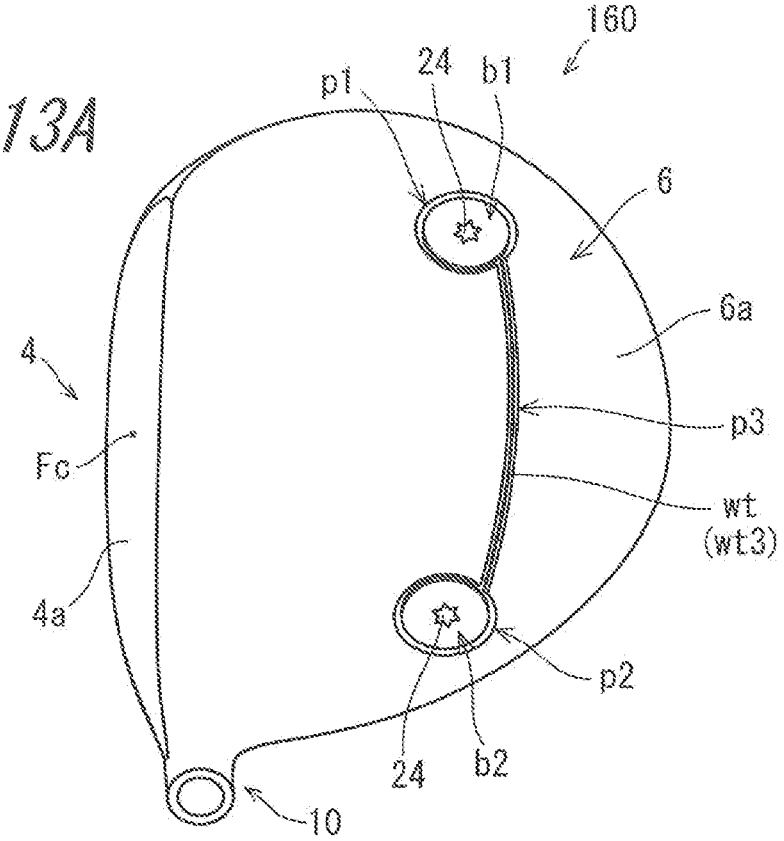
FIG. 13A is a plan view of a head according to an eighth embodiment.
Figure 13B:
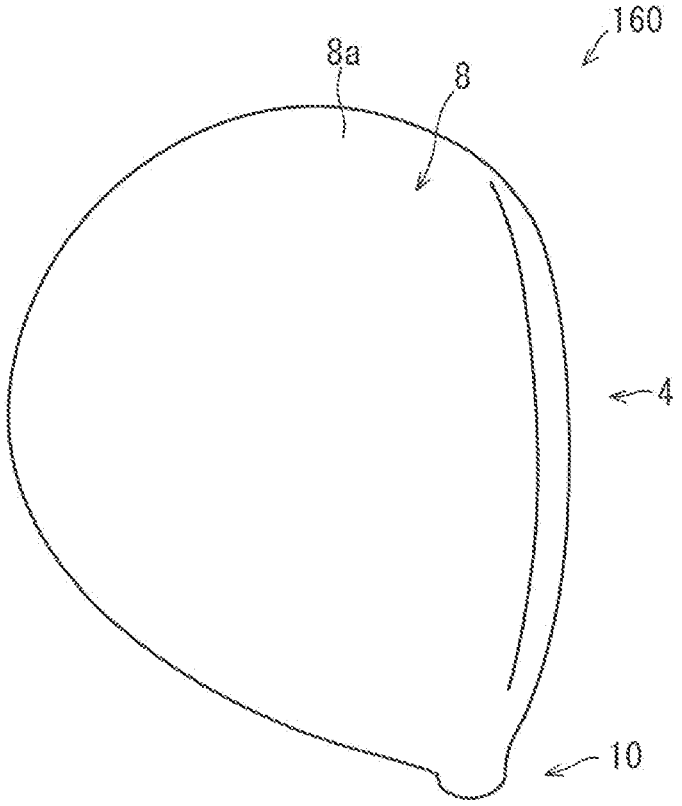
FIG. 13B is a bottom view thereof.

FIG. 13A is a plan view of a head 160 according to an eighth embodiment as viewed from the crown side. FIG. 13B is a bottom view of the head 160 as viewed from the sole side. In the head 160, a crown portion 6 includes a first wound portion b1 and a second wound portion b2. The crown portion 6 further includes a first port p1 that houses the first wound portion b1, a second port p2 that houses the second wound portion b2, and a housing recess p3 that extends from the first port p1 to the second port p2 and houses a third part wt3 of a weight member wt. A sole portion 8 does not have a first wound portion b1 or a second wound portion b2. Except for the above-described structures, the head 160 is the same as the head 2.

Figure 14:
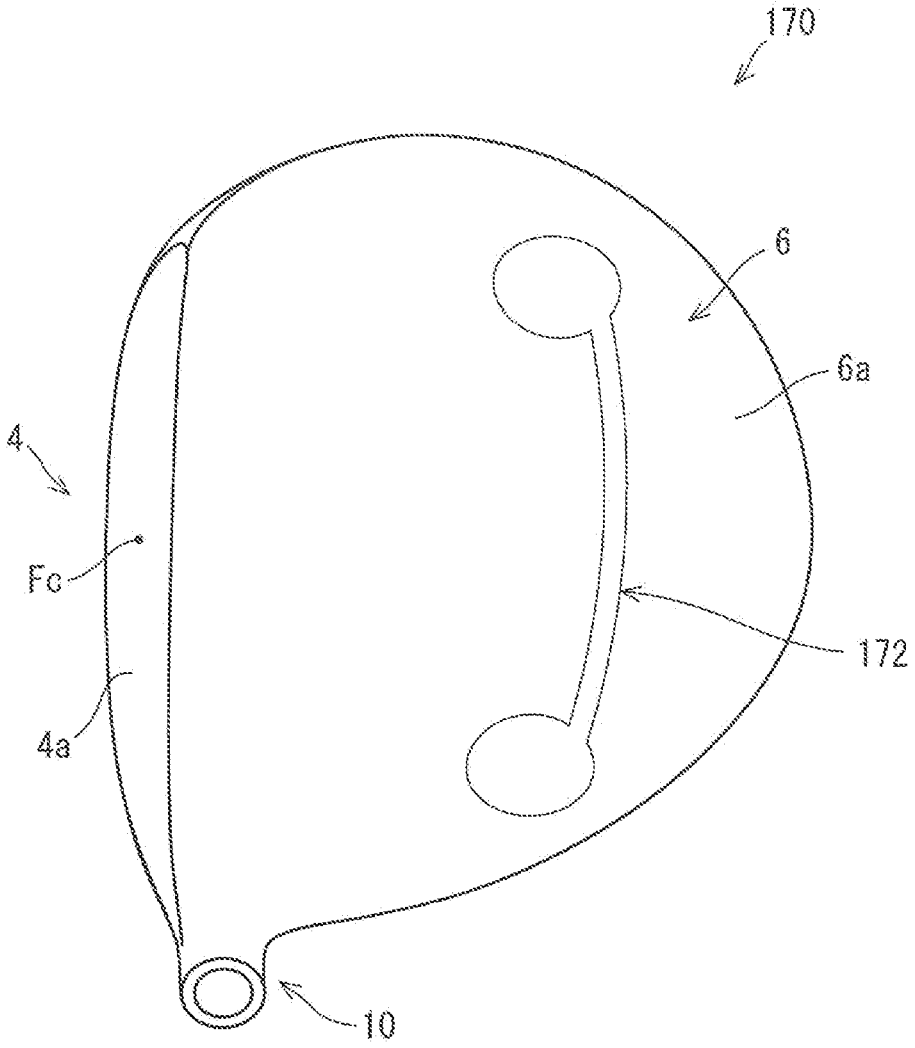
FIG. 14 is a plan view of a head according to a ninth embodiment.

FIG. 14 is a plan view of a head 170 according to a ninth embodiment as viewed from the crown side. A cover member 172 that covers the first port p1, the second port p2, and the housing recess p3 is attached to the head 170. The cover member 172 is attached to the head 170 by a known method such as fitting or screwing. The cover member 172 may cover at least a part of the first port p1, the second port p2, or the housing recess p3. For example, a first cover member that covers the first port p1 and a second cover member that covers the second port p2 may be provided. The head 170 is the same as the head 160 except for the presence of the cover member 172.

Figure 15A:
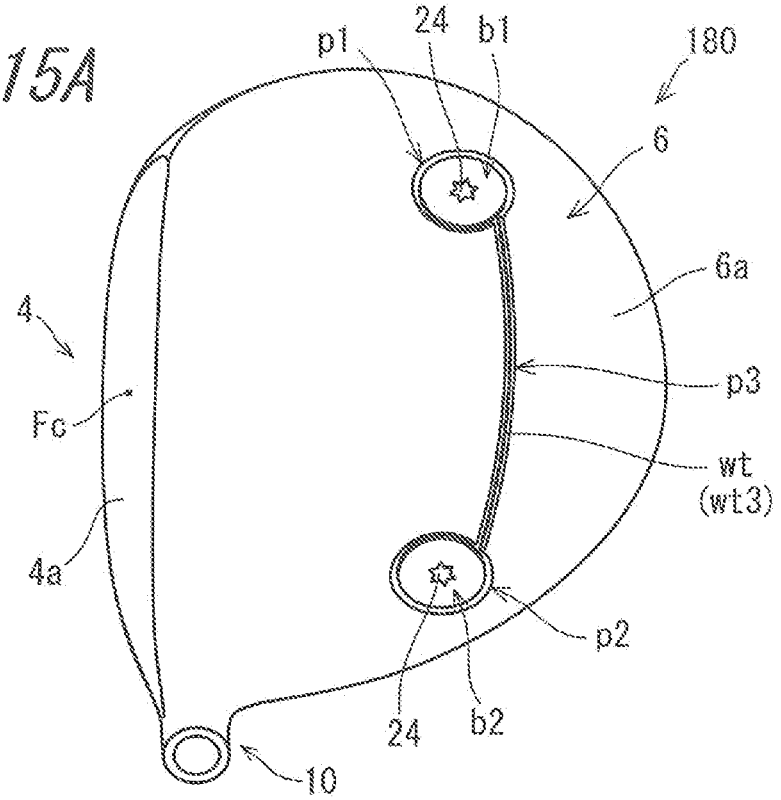
FIG. 15A is a plan view of a head according to a tenth embodiment.
Figure 15B:
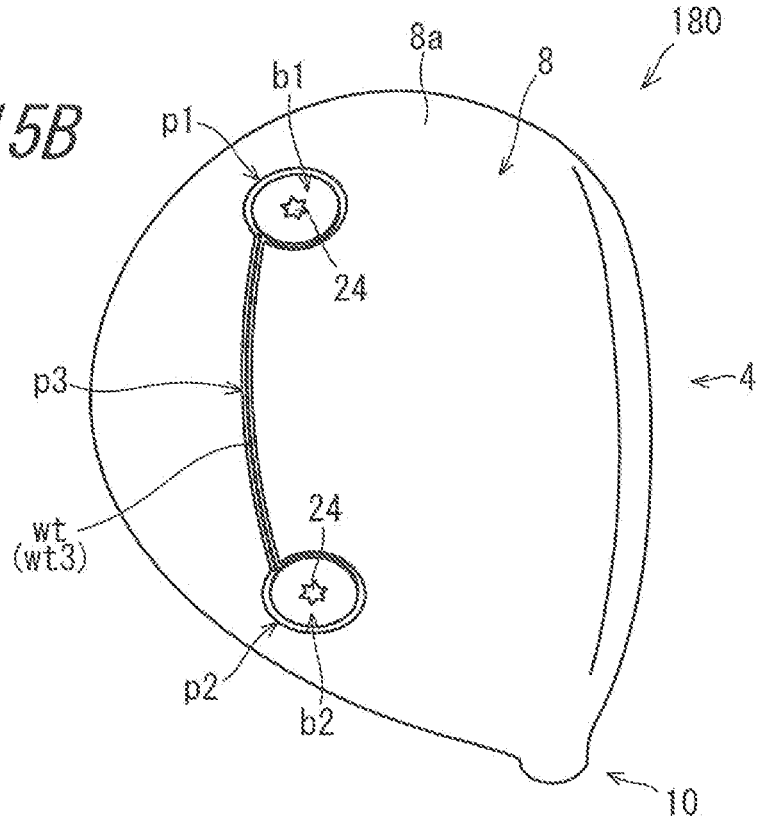
FIG. 15B is a bottom view thereof.

FIG. 15A is a plan view of a head 180 according to a tenth embodiment as viewed from the crown side. FIG. 15B is a bottom view of the head 180 as viewed from the sole side. In the head 180, a crown portion 6 includes a first wound portion b1 and a second wound portion b2. The crown portion 6 further includes a first port p1 that houses the first wound portion b1, a second port p2 that houses the second wound portion b2, and a housing recess p3 that extends from the first port p1 to the second port p2 and houses a third part wt3 of a weight member wt. In addition, a sole portion 8 of the head 180 includes a first wound portion b1 and a second wound portion b2. The sole portion 8 further includes a first port p1 that houses the first wound portion b1, a second port p2 that houses the second wound portion b2, and a housing recess p3 that extends from the first port p1 to the second port p2 and houses a third part wt3 of a weight member wt.

Figure 16A:
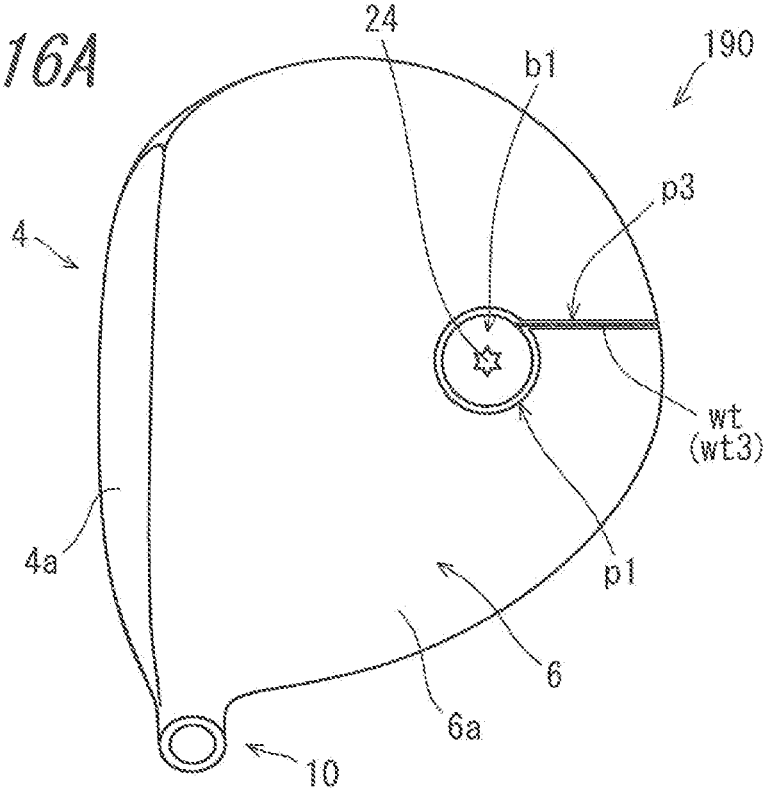
FIG. 16A is a plan view of a head according to an eleventh embodiment.
Figure 16B:
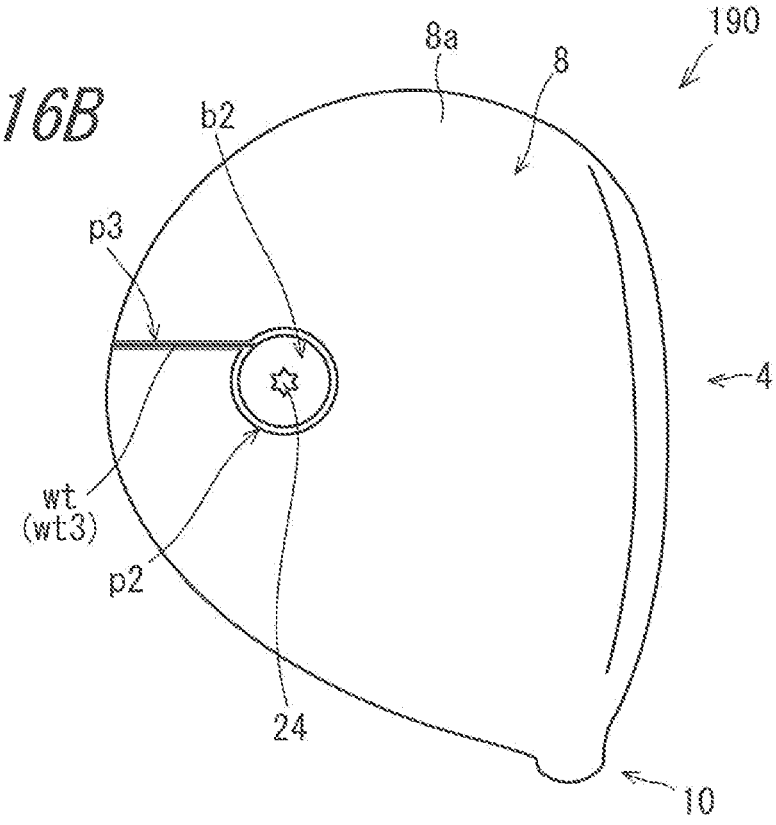
FIG. 16B is a bottom view thereof.

FIG. 16A is a plan view of a head 190 according to an eleventh embodiment as viewed from the crown side. FIG. 16B is a bottom view of the head 190 as viewed from the sole side. In the head 190, a crown portion 6 includes a first wound portion b1, and a sole portion 8 includes a second wound portion b2. The crown portion 6 includes a first port p1 that houses the first wound portion b1. The sole portion 8 includes a second port p2 that houses the second wound portion b2. A housing recess p3 extends from the crown portion 6 to the sole portion 8. The housing recess p3 extends from the first port p1 located in the crown portion 6 to the second port p2 located in the sole portion 8. The housing recess p3 is a groove that houses a third part wt3 of a weight member wt.

Figure 17:
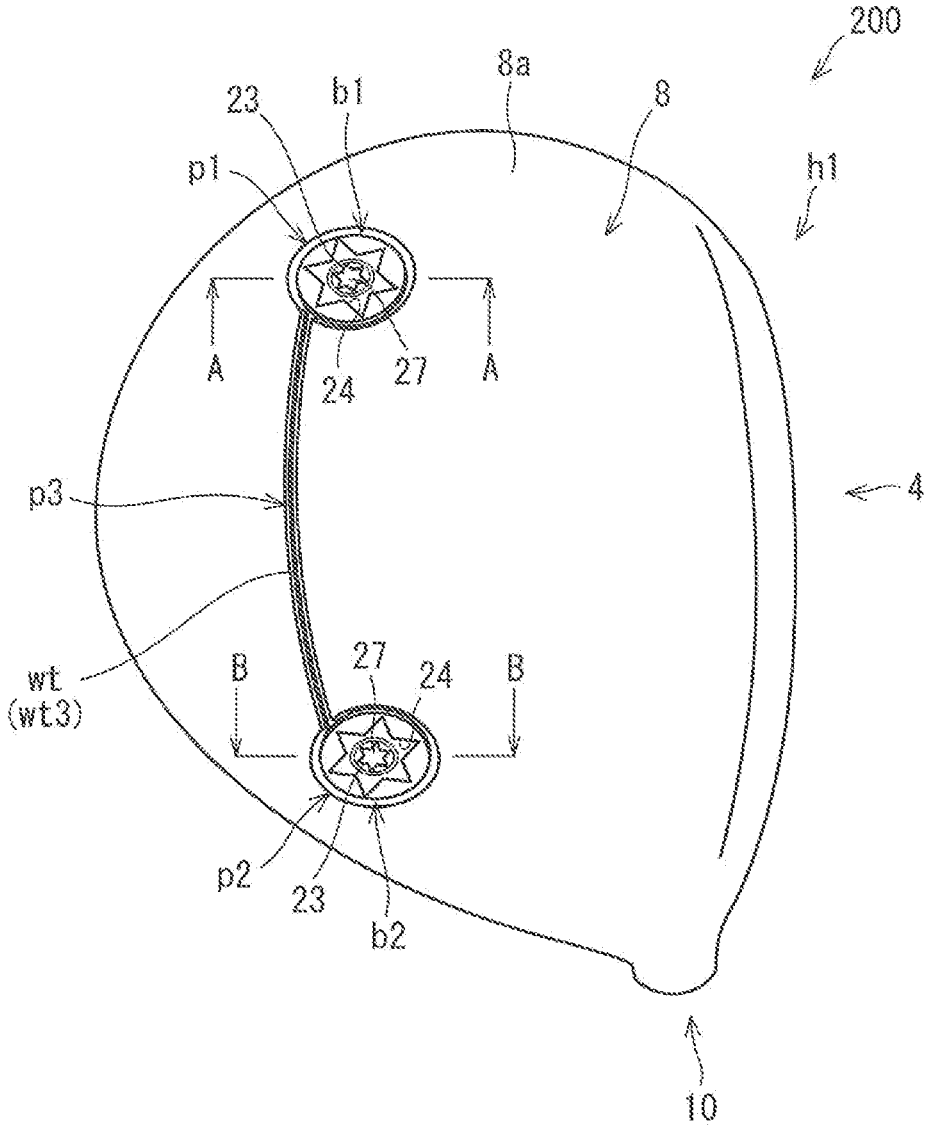
FIG. 17 is a bottom view of a head according to a twelfth embodiment.
Figure 18A:
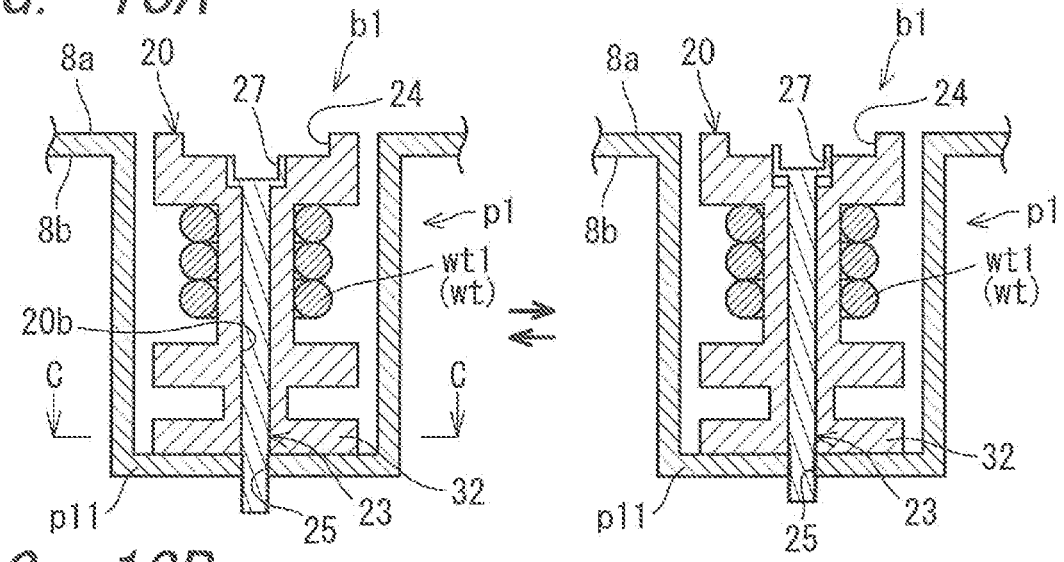
FIG. 18A is a cross sectional view taken along line A-A in FIG. 17.
Figure 18B:
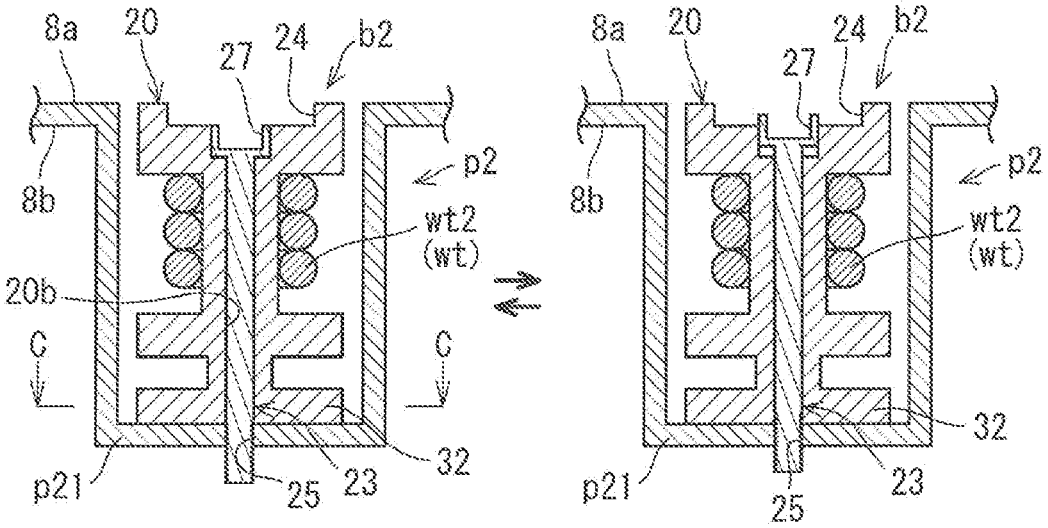
FIG. 18B is a cross sectional view taken along line B-B in FIG. 17.
Figure 18C:
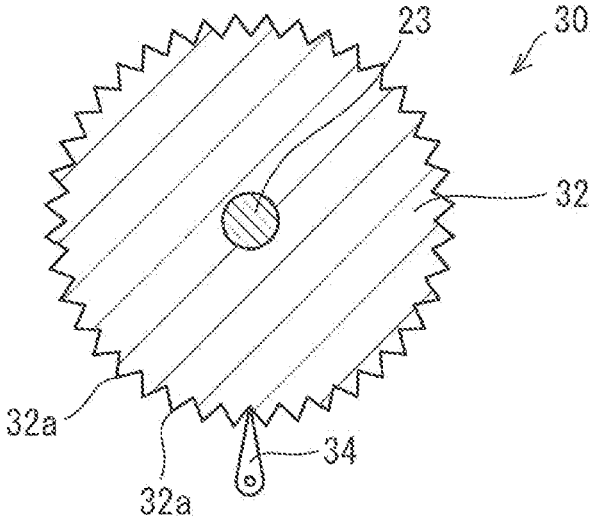
FIG. 18C is a cross-sectional view taken along lines C-C in FIG. 18A and FIG. 18B.

FIG. 17 is a bottom view of a golf club head 200 according to a twelfth embodiment as viewed from the sole side. FIG. 18A is a cross-sectional view taken along line A-A in FIG. 17. FIG. 18B is a cross-sectional view taken along line B-B in FIG. 17. FIG. 18C is a cross-sectional view taken along lines C-C in FIG. 18A and FIG. 18B.

The head 200 (head body h1) includes a face portion 4, a crown portion 6, a sole portion 8, and a hosel portion 10. The plan view of the head 200 as viewed from the crown side is the same as FIG. 1. The sole portion 8 includes a sole outer surface 8*a* and a sole inner surface 8*b* (see FIG. 18A and FIG. 18B).

The head 200 includes a first wound portion b1, a second wound portion b2, and a weight member wt. The first wound portion b1 and the second wound portion b2 are attached to the head body h1, and the weight member wt is stretched between the first wound portion b1 and the second wound portion b2. In the present embodiment, the sole portion 8 includes the first wound portion b1 and the second wound portion b2. The first wound portion b1 and the second wound portion b2 are connected to each other by the weight member wt. The first wound portion b1 is provided on the toe side with respect to the second wound portion b2. The first wound portion b1 is provided on the toe side with respect to the face center Fc. The second wound portion b2 is provided on the heel side with respect to the face center Fc.

The weight member wt has a long and thin shape. The length of the weight member wt is set such that the weight member wt can connect the first wound portion b1 and the second wound portion b2, and have a first part wt1 to be wound around the first wound portion b1 or a second part wt2 to be wound around the second wound portion b2.

As shown in FIG. 18A, the first wound portion b1 includes a reel portion 20 and a screw 23. The reel portion 20 constitutes a reel (spool). The screw 23 penetrates through a through hole 20*b* that is formed at the center of the reel portion 20. Further, the screw 23 is screwed into a female screw hole 25 that is formed in a bottom portion p11 of a first port p1. The reel portion 20 can freely rotate with respect to the screw 23.

The weight member wt is wound around the first wound portion b1 (reel portion 20). Of the weight member wt, a portion that is wound around the first wound portion b1 is referred to as the first part wt1. The length (length in the longitudinal direction) of the first part wt1 varies depending on how much the weight member wt is wound around the first wound portion b1. The weight of the first part wt1 varies depending on how much the weight member wt is wound around the first wound portion b1.

The first wound portion b1 has an engaging hole 24. The engaging hole 24 is shaped so as to engage with the tip portion of a tool that is used to rotate the first wound portion b1. The tool is a screw driver, for example. The first wound portion b1 can be rotated by this tool.

The screw 23 includes a head portion that has a screw hole 27. The screw hole 27 is shaped so as to engage with the tip portion of a tool that is used to rotate the screw 23. The tool is a screw driver, for example. The screw 23 can be tightened or loosened with this tool.

The configuration of the second wound portion b2 is the same as that of the first wound portion b1. As shown in FIG. 18B, the second wound portion b2 includes a reel portion 20 and a screw 23. The reel portion 20 constitutes a reel (spool). The reel portion 20 can freely rotate with respect to the screw 23. The reel portion 20 can rotate about the screw 23. The weight member wt is wound around the second wound portion b2 (reel portion 20). Of the weight member wt, a portion that is wound around the second wound portion b2 is referred to as the second part wt2. The length (length in the longitudinal direction) of the second part wt2 varies depending on how much the weight member wt is wound around the second wound portion b2. The weight of the second part wt2 varies depending on how much the weight member wt is wound around the second wound portion b2.

The rotation of the first wound portion b1 and the rotation of the second wound portion b2 can be linked together by the weight member wt. When a rotation force is applied to the first wound portion b1 to rotate the first wound portion b1 in the reel-in direction, this rotation can involve the rotation of the second wound portion b2 in the reel-out direction. When a rotation force is applied to the second wound portion b2 to rotate the second wound portion b2 in the reel-in direction, this rotation can involve the rotation of the first wound portion b1 in the reel-out direction. This linkage provides easier adjustability of the position of the center of gravity of the head.

The weight member wt includes a third part wt3. The third part wt3 is a portion that is not wound around any wound portion b1 or b2. In the present embodiment, the third part wt3 is a part located between the first part wt1 and the second part wt2.

The second wound portion b2 has an engaging hole 24. The engaging hole 24 is shaped so as to engage with the tip portion of a tool that is used to rotate the second wound portion b2. The tool is a screw driver, for example. This tool is also used as the tool for rotating the first wound portion b1.

As shown in FIG. 18C, the first wound portion b1 includes a rotation resistance mechanism 30. The rotation resistance mechanism 30 includes a rotary gear 32 and a gear engaging portion 34. The rotary gear 32 is integrally formed with the reel portion 20 as a single-piece member. The rotary gear 32 rotates together with the reel portion 20. The gear engaging portion 34 engages with teeth 32*a* of the rotary gear 32. This engagement prevents the rotation of the rotary gear 32. When the rotary gear 32 is about to rotate, the rotary gear 32 applies a stress on the gear engaging portion 34. The gear engaging portion 34 is elastically deformed by the stress applied from the rotary gear 32. When the magnitude of the stress from the rotary gear 32 exceeds a predetermined value, the degree of the elastic deformation of the gear engaging portion 34 increases, and the gear engaging portion 34 gets over one of the teeth 32*a*. By repeating the elastic deformation, the rotary gear 32 rotates while receiving the rotational resistance. The rotation resistance mechanism 30 applies a same magnitude of resistance force to the rotation of the rotary gear 32 in the reel-in direction and the rotation of the rotary gear 32 in the reel-out direction.

The second wound portion b2 also includes the same rotation resistance mechanism 30 as in the first wound portion b1.

When the first wound portion b1 is rotated in the reel-in direction, the weight of the first part wt1 increases and the weight of the second part wt2 decreases. That is, the weight of the weight member wt is distributed largely to the first part wt1. As a result, the position of the center of gravity of the head 200 is shifted toward the first wound portion b1. In the present embodiment, the position of the center of gravity of the head 200 is shifted toward the toe side.

When the second wound portion b2 is rotated in the reel-in direction, the weight of the second part wt2 increases and the weight of the first part wt1 decreases. That is, the weight of the weight member wt is distributed largely to the second part wt2. As a result, the position of the center of gravity of the head 200 is shifted toward the second wound portion b2. In the present embodiment, the position of the center of gravity of the head 200 is shifted to the heel side.

The rotation resistance mechanism 30 contributes to keeping the tension applied to the third part wt3.

FIG. 18A shows a state in which the screw 23 is tightened and a state in which the screw 23 is loosened. A left-side part of FIG. 18A shows the state in which the screw 23 is tightened. A right-side part of FIG. 18A shows the state in which the screw 23 is loosened.

Similarly, FIG. 18B shows a state in which the screw 23 is tightened and a state in which the screw 23 is loosened. A left-side part of FIG. 18B shows the state in which the screw 23 is tightened. A right-side part of FIG. 18B shows the state in which the screw 23 is loosened.

As shown in FIG. 18A, the rotary gear 32 is pressed against the bottom portion p11 of the first port p1 by tightening the screw 23. The rotation of the first wound portion b1 (reel portion 20) can be stopped by tightening the screw 23. Slack of the third part wt3 can be prevented by preventing the rotation of the first wound portion b1. Loosening the screw 23 allows the first wound portion b1 to rotate.

As shown in FIG. 18B, the rotary gear 32 is pressed against a bottom portion p21 of a second port p2 by tightening the screw 23. The rotation of the second wound portion b2 (reel portion 20) can be stopped by tightening the screw 23. Slack of the third part wt3 can be prevented by preventing the rotation of the second wound portion b2. Loosening the screw 23 allows the second wound portion b2 to rotate.

As described above, the present embodiment includes a rotation stop mechanisms that prevent the rotations of the wound portions b1 and b2. The rotation stop mechanism can switch between the rotation stopped state and the rotation allowed state by controlling the screw 23.

Figure 19:
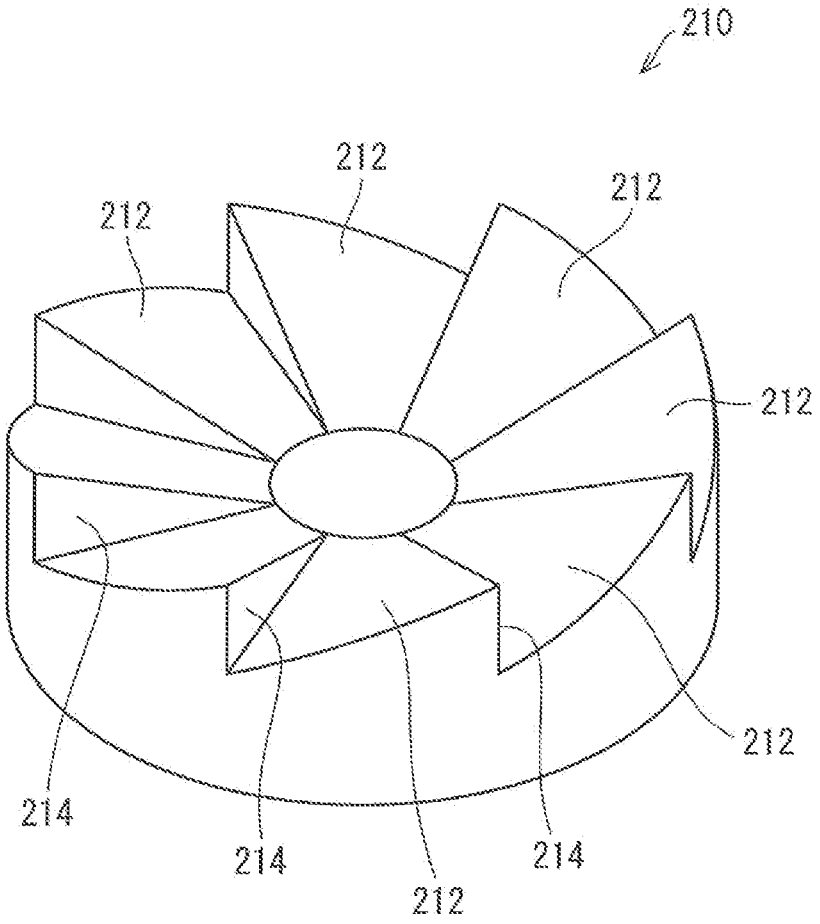
FIG. 19 is a perspective view showing a toothed surface forming a locking and tightening mechanism that is an example of a rotation regulating mechanism.

FIG. 19 is a perspective view showing a toothed surface 210 capable of stopping the rotation of the reel portions 20. In the twelfth embodiment (FIG. 18A to FIG. 18C), the bottom portions p11 and P21 of the respective ports are brought into contact with the corresponding rotary gears 32, whereby the rotation of the reel portions 20 is stopped. From the viewpoint of ensuring the stop of the rotation of the reel portions 20, a toothed surface can be formed on the bottom portions p11 and p21 of the respective ports and the rotary gears 32. The effect of the stop of the rotation can be enhanced by engaging these toothed surfaces with each other. The toothed surface 210 is an example of such toothed surfaces. The toothed surface 210 includes first surfaces 212 arranged at predetermined angle intervals in the circumferential direction, and second surfaces 214 arranged each between two adjacent first surfaces 212. In the circumferential direction, the first surfaces 212 and the second surfaces 214 are alternately arranged. The first surfaces 212 are arranged at equal intervals in the circumferential direction. The second surfaces 214 are arranged at equal intervals in the circumferential direction. Each first surface 212 is an inclined surface. Each first surface 212 is inclined with respect to the axial direction and is inclined with respect to the circumferential direction. Each second surface 214 is parallel to the axial direction and is perpendicular to the circumferential direction.

Figure 20:
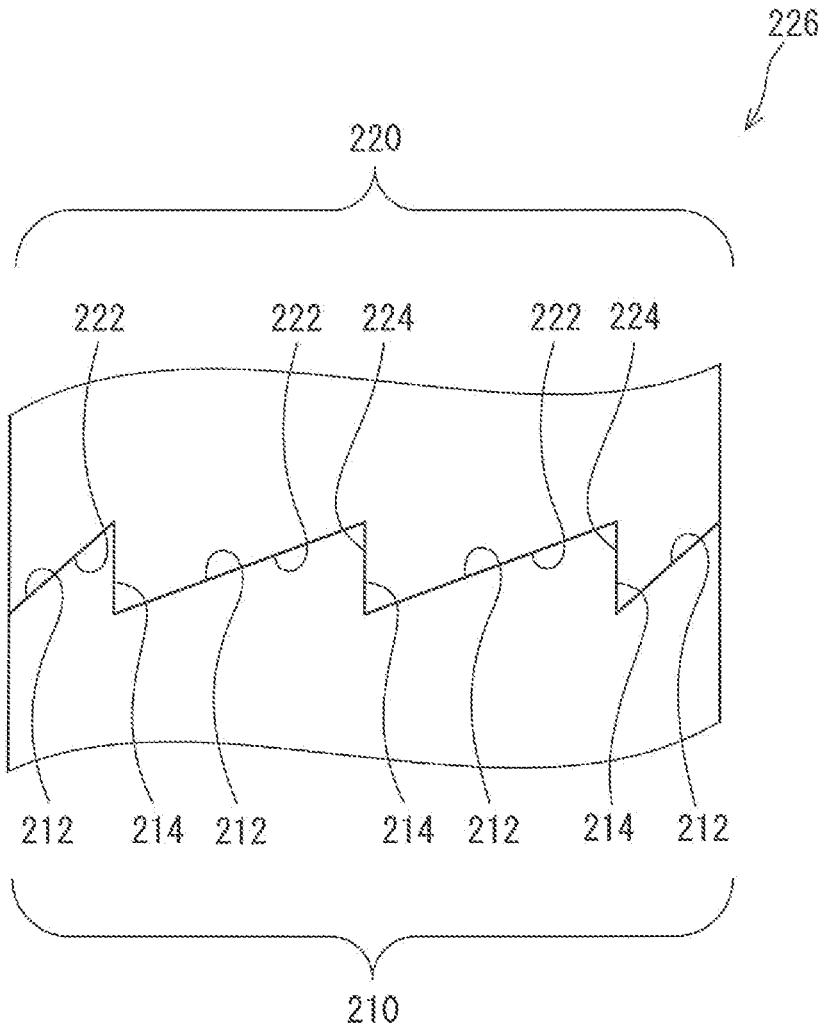
FIG. 20 is a side view of the locking and tightening mechanism including the toothed surface in FIG. 19.

FIG. 20 is a side view showing a state in which the toothed surface 210 engages with an opposed surface. The opposed surface is a toothed surface 220. The toothed surface 220 is obtained by transferring the toothed surface 210. The toothed surface 220 includes first surfaces 222 and second surfaces 224. In the circumferential direction, the first surfaces 222 and the second surfaces 224 are alternately arranged. The first surfaces 222 are arranged at equal intervals in the circumferential direction. The second surfaces 224 are arranged at equal intervals in the circumferential direction. Each first surface 222 is an inclined surface. Each first surface 222 is inclined with respect to the axial direction and is inclined with respect to the circumferential direction. Each second surface 224 is parallel to the axial direction and is perpendicular to the circumferential direction.

As shown in FIG. 20, when the toothed surface 210 engages with the toothed surface 220 (hereinafter this state is referred to as an engaged state), the first surfaces 212 and corresponding first surfaces 222 are in surface contact with each other, and the second surfaces 214 and corresponding second surfaces 224 are in surface contact with each other.

For example, in the embodiment of FIG. 18A to FIG. 18C, the toothed surface 210 may be formed on the upper surface of each of the bottom portions p11 and p21 of the respective ports, and the toothed surface 220 may be formed on the lower surface of each rotary gear 32. The contact between the toothed surface 210 and the toothed surface 220 rotates the reel portion 20 in the reel-in direction. That is, when the toothed surface 210 and the toothed surface 220 are brought into contact with each other in a state where the positional relationship in the circumferential direction between these surfaces is different from the above-described engaged state, the contact between the inclined surfaces (contact between first surfaces 212 and corresponding first surfaces 222) causes a rotational moment that rotates the reel portion 20 such that these surfaces are brought about the engaged state. This rotation moment rotates the reel portion 20 in the reel-in direction. The toothed surface 210 and the toothed surface 220 constitute a locking and tightening mechanism 226 configured to rotate the reel portion 20 in the reel-in direction and to prevent further rotation of the reel portion 20. The locking and tightening mechanism 226 enhances the effect of preventing the slack the third part wt3.

Advantageous Effect

The golf club heads shown in the above-described embodiments of the present disclosure exhibit the following advantageous effects.

The weight distribution of the weight member wt can be changed by changing the ratio of the amount of the weight member wt wound around the first wound portion b1 to the amount of the weight member wt wound around the second wound portion b2. The position of the center of gravity of the head can be shifted toward the first wound portion b1 by increasing the amount of the weight member wt wound around the first wound portion b1, that is, by increasing the amount of the first part wt1. The position of the center of gravity of the head can be shifted toward the second wound portion b2 by increasing the amount of the weight member wt wound around the second wound portion b2, that is, by increasing the amount of the second part wt2. The amount of the weight member wt wound around the first wound portion b1 and the amount of the weight member wt wound around the second wound portion b2 each are also referred to as a weight-member wound amount. The position of the center of gravity of the head is adjusted by changing the weight-member wound amount of at least either the first part wt1 or the second part wt2.

The position of the first wound portion b1 and the position of the second wound portion b2 can be freely set. This can realize a desired adjustment of the position of the center of gravity of the head. For example, as shown in the head 2 of FIG. 2, when the first wound portion b1 is disposed on the toe side, and the second wound portion b2 is disposed on the heel side, then the position of the center of gravity of the head can be adjusted in the toe-heel direction. For example, as shown in the head 190 of FIGS. 16A and 16B, when the first wound portion b1 is disposed in the crown portion 6, and the second wound portion b2 is disposed in the sole portion 8, then the position of the center of gravity of the head can be adjusted in the up-down direction. Since the position of the first wound portion b1 and the position of the second wound portion b2 can be set independently of each other, various adjustments can be made. The degree of freedom of the adjustment can be further increased by disposing a projection(s) in addition to the first wound portion b1 and the second wound portion b2.

The position of the center of gravity of the head can be shifted in various directions because of the degree of freedom in the arrangement of the first wound portion b1, the second wound portion b2, and the projection(s). In the embodiment shown in FIG. 2, the position of the center of gravity of the head can be shifted in the toe-heel direction. In the embodiment of FIG. 16A and FIG. 16B, the position of the center of gravity of the head can be shifted in the up-down direction. In the embodiment of FIG. 10, the position of the center of gravity of the head can be shifted in the face-back direction and the toe-heel direction. For example, in the embodiment of FIG. 2, the position of the first wound portion b1 in the face-back direction may differs from the position of the second wound portion b2 in the face-back direction. In this case, the position of the center of gravity of the head can be shifted in the toe-heel direction and the face-back direction. For example, in the embodiment of FIG. 16A and FIG. 16B, the position of the first wound portion b1 in the toe-heel direction may differ from the position of the second wound portion b2 in the toe-heel direction. In this case, the position of the center of gravity of the head can be shifted in the up-down direction and the toe-heel direction. Thus, various adjustments can be made. The weight member wt, which can be wound, enables a head to have various weight distributions because of the flexibility of the weight member wt.

Two or more pairs of the first wound portion b1 and the second wound portion b2 may be provided. The degree of freedom in adjusting the position of the center of gravity of the head can be further increased by the two or more pairs of them. For example, in the head 180 of FIG. 15A and FIG. 15B, a first pair is disposed in the crown portion 6, and a second pair is disposed in the sole portion 8, which enables an adjustment with higher degree of freedom.

The weight member wt may be replaceable. For example, the weight member wt may be replaced with another weight member wt having a weight per unit length different from that of the former weight member wt. Further, two or more bundled weight members wt may be used. These configurations increase the degree of freedom of the adjustment.

The presence of the first port p1 can prevent the first wound portion b1 from protruding from the outer surface of the head. The presence of the second port p2 can prevent the second wound portion b2 from protruding from the outer surface of the head. The presence of the housing recess p3 can prevent the third part wt3 of the weight member wt from protruding from the outer surface of the head. These states in which those portions do not protrude from the head outer surface improve the appearance of the head and reduce air resistance. In addition, in the sole portion 8, these states reduce ground resistance.

In the embodiment of FIG. 3A to FIG. 3C, each of the first wound portion b1 and the second wound portion b2 can rotate in the reel-in direction and the reel-out direction. Each of the first wound portion b1 and the second wound portion b2 has a rotational resistance both when rotated in the reel-in direction and when rotated in the reel-out direction. Neither the first wound portion b1 nor the second wound portion b2 rotates when a rotational force (moment) less than a predetermined threshold is applied. Each of the first wound portion b1 and the second wound portion b2 rotates when a rotational force equal to or greater than the threshold is applied. This configuration easily achieves a state (hereinafter referred to as a weight fixed state) in which the rotation of the first wound portion b1 and the rotation of the second wound portion b2 are prevented while tension is applied to the third part wt3.

In the embodiment of FIG. 4A to FIG. 4C, each of the first wound portion b1 and the second wound portion b2 can rotate in the reel-in direction and the reel-out direction. Each of the first wound portion b1 and the second wound portion b2 has the ratchet mechanism. The ratchet mechanism can switch the rotation direction between the reel-in direction and the reel-out direction. This configuration easily achieves the weight fixed state in which the rotation of the first wound portion b1 and the rotation of the second wound portion b2 are prevented while tension is applied to the third part wt3.

In the embodiment of FIG. 5A and FIG. 5B, each of the first wound portion b1 and the second wound portion b2 is configured to perform an alternate action in which each of the first wound portion b1 and the second wound portion b2 is independently switched between the projecting position and the pushed-in position by each pushing of the first wound portion b1 or the second wound portion b2. The rotation of the first wound portion b1 and the rotation of the second wound portion b2 are allowed when they are at the projecting position, and the rotation of the first wound portion b1 and the rotation of the second wound portion b2 are prevented when they are at the pushed-in position. This configuration easily achieves the weight fixed state in which the rotation of the first wound portion b1 and the rotation of the second wound portion b2 are prevented while tension is applied to the third part wt3. Furthermore, the first wound portion b1 and the second wound portion b2 can also be rotated by fingers when they are at the projecting position.

Not only the embodiment of FIG. 5A, 5B but also other embodiments may include the first wound portion b1 and the second wound portion b2 each have a switching mechanism capable of switching between a rotation allowed state and a rotation prevented state. In this case, for adjusting the position of the center of gravity of the head, the first wound portion b1 and the second wound portion b2 can be set to the rotation allowed state, and for achieving weight fixed state, the first wound portion b1 and the second wound portion b2 can be set to the rotation prevented state.

In the embodiments of FIG. 3A to FIG. 3C, FIG. 4A to FIG. 4C, FIG. 5A, FIG. 5B, and FIG. 18A to FIG. 18C, the first wound portion b1 and the second wound portion b2 each have a rotation regulating mechanism that regulates the rotation of the first wound portion b1 or the rotation of the second wound portion b2 in the reel-out direction. The rotation resistance mechanism 30 (FIG. 3C), the ratchet mechanism 40 (FIG. 4C), the rotation prevention mechanism 50 (FIG. 5A, FIG. 5B), and the rotation stop mechanism (FIG. 18A, FIG. 18B) are examples of the rotation regulating mechanism. The rotation regulating mechanism can easily achieve the weight fixed state in which the third part wt3 has no slack. Furthermore, in the embodiments shown in FIG. 18A and FIG. 18B, since the two kinds of rotation regulating mechanisms are provided, the slack of the third part wt3 can be effectively suppressed.

As described above, the locking and tightening mechanism 226 shown in FIG. 19 and FIG. 20 may be applied to the embodiment of FIG. 18A and FIG. 18B, for example. Further, the locking and tightening mechanism 226 can be used instead of the rotation prevention mechanism 50 in the embodiment of FIG. 5A and FIG. 5B. The locking and tightening mechanism 226 can effectively suppress the slack of the third part wt3.

As shown in the head 100 of FIG. 7, the first part wt1 and the second part wt2 can be visually recognized from the outside of the head by imparting transparency to the first wound portion b1 and the second wound portion b2. In the head 110 of FIG. 8, the first part wt1 and the second part wt2 can be visually recognized from the outside of the head through the notch 20*a*. These structures allow the user to see the wound amount of first part wt1 and the second part wt2.

When at least either the first part wt1 or the second part wt2 can be visually recognized, the wound amount of the other one can be assumed. From this viewpoint, a head that satisfies the following item (a) or (b) is preferable. As in the embodiments shown in FIG. 7 and FIG. 8, a head that satisfy the following (a) and (b) is more preferable.

(a) a head configured such that the first part wound around the first wound portion is visually recognized from the outside of the head (b) a head configured such that the second part wound around the second wound portion is visually recognized from the outside of the head The configuration in which the first part wt1 and the second part wt2 can be visually recognized from the outside of a head can be achieved by not only the transparency or notch, but also projecting the wound portions b1 and b2 from the head outer surface, and widening a gap between the wound portions b1 and b2 and the ports p1 and p2, for example.

As shown in the heads 120, 130, and 140 of FIG. 9 to FIG. 11, one or more projections around which the third part wt3 of the weight member wt is wound may be provided in addition to the first wound portion b1 and the second wound portion b2. The degree of freedom of adjustment is further increased by winding the weight member wt around the one or more projections in addition to the first wound portion b1 and the second wound portion b2.

As shown in the head 140 of FIG. 11, the first wound portion b1, the second wound portion b2, and the third part wt3 of the weight member wt may protrude from the head outer surface. The head 140 does not need to include a first port p1, a second port p2, or a housing recess p3. Accordingly, the head body h1 is easily formed, and the degree of freedom in designing the head body h1 is increased. In addition, when the first wound portion b1 and the second wound portion b2 protrude from the head outer surface as in the head 150 of FIG. 12, the first wound portion b1 and the second wound portion b2 can be rotated by fingers without using a tool.

As in the head 150 of FIG. 12, the first wound portion b1 and the second wound portion b2 may be non-rotatable. In this case, for example, the weight member wt can be wound around the first wound portion b1 and the second wound portion b2 with fingers. Either the first wound portion b1 or the second wound portion b2 may be rotatable, and the other may be non-rotatable. From the viewpoint of the adjustability of the position of the center of gravity of the head, each of the first wound portion b1 and the second wound portion b2 is preferably rotatable in the reel-in direction and the reel-out direction.

In the head 170 of FIG. 14, the cover member 172 is provided. This configuration can protect the first wound portion b1, the second wound portion b2, and the third part wt3 from the intrusion of foreign matters. In addition, this configuration prevents the first wound portion b1, the second wound portion b2, and the third part wt3 from catching grass and the like. The cover member 172 may have transparency. This transparency allows the first wound portion b1, the second wound portion b2, and/or the third part wt3 covered with the cover member 172 to be visually recognized from the outside of the head.

In a head having a large volume, the first wound portion b1 and the second wound portion b2 can be located farther away from each other, and the degree of freedom in the positions of the first wound portion b1 and the second wound portion b2 is increased. Accordingly, the adjustable range and the degree of freedom in adjustment of the position of the center of gravity of the head are increased. From these viewpoints, a hollow head having a hollow portion is preferable. From the same viewpoint, the volume of the head is preferably greater than or equal to 100 cc, more preferably greater than or equal to 200 cc, still more preferably greater than or equal to 300 cc, still more preferably greater than or equal to 350 cc, still more preferably greater than or equal to 400 cc, and yet still more preferably greater than or equal to 420 cc. From the viewpoint of golf rules, the head volume is preferably less than or equal to 470 cc, and more preferably less than or equal to 460 cc.

Regarding the above-described embodiments, the following clauses are disclosed.

Clause 1

A golf club head having a face portion, a crown portion and a sole portion, the golf club head including:

a weight member that is configured to be wound;

a first wound portion around which a first part of the weight member is to be wound; and a second wound portion that is disposed apart from the first wound portion and around which a second part of the weight member is to be wound, wherein a position of a center of gravity of the golf club head is adjusted by changing a weight ratio of the first part to the second part.

Clause 2

The golf club head according to clause 1, wherein at least either the first wound portion or the second wound portion is rotatable in a reel-in direction and a reel-out direction.

Clause 3

The golf club head according to clause 1 or 2, wherein the first wound portion and the second wound portion are rotatable in a reel-in direction and a reel-out direction.

Clause 4

The golf club head according to clause 3, wherein each of the first wound portion and the second wound portion includes a rotation regulating mechanism that regulates the rotation of the first wound portion or the second wound portion in the reel-out direction.

Clause 5

The golf club head according to any one of clauses 1 to 4, wherein the golf club head further includes:

a first port that houses the first wound portion including the first part;

a second port that houses the second wound portion including the second part; and a housing recess that houses a third part that is a part of the weight member other than the first part or the second part.

Clause 6

The golf club head according to any one of clauses 1 to 5, wherein the first wound portion and the second wound portion are disposed in the sole portion.

Clause 7

The golf club head according to any one of clauses 1 to 5, wherein the first wound portion and the second wound portion are disposed in the crown portion.

Clause 8

The golf club head according to any one of clauses 1 to 5, wherein the first wound portion is disposed in the sole portion, and the second wound portion is disposed in the crown portion.

Clause 9

The golf club head according to any one of clauses 1 to 8, wherein the golf club head satisfies the following (a) and/or (b):

(a) the golf club head is configured such that the first part wound around the first wound portion is visually recognized from an outside of the golf club head; and (b) the golf club head is configured such that the second part wound around the second wound portion is visually recognized from the outside of the golf club head.

Clause 10

A golf club head having a face portion, a crown portion and a sole portion, the golf club head including:

a weight member that is configured to be wound;

a first wound portion around which a first part of the weight member is to be wound; and a second wound portion that is disposed apart from the first wound portion and around which a second part of the weight member is to be wound, wherein a position of a center of gravity of the golf club head is adjusted by changing at least either a wound amount of the first part or a wound amount of the second part.

LIST OF REFERENCE NUMERALS

2, 100, 110, 120, 130, 140, 150, 160, 170, 180, 190, 200 Head
4 Face portion
4*a* Face outer surface
6 Crown portion
6*a* Crown outer surface
8 Sole portion
8*a* Sole outer surface
8*b* Sole inner surface
10 Hosel portion
20 Reel portion
20*a* Notch
23 Screw
24 Engaging hole
30 Rotation resistance mechanism
40 Ratchet mechanism
50 Rotation prevention mechanism
60 Alternate mechanism
70 Reel portion
172 Cover member
b1 First wound portion
b2 Second wound portion
p1 First port
p2 Second port
wt Weight member
wt1 First part
wt2 Second part
wt3 Third part The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head including a face portion, a crown portion and a sole portion, the golf club head comprising:

a weight member that is configured to be wound;

a first wound portion around which a first part of the weight member is to be wound; and a second wound portion that is disposed apart from the first wound portion and around which a second part of the weight member is to be wound, wherein a position of a center of gravity of the golf club head is adjusted by changing a weight ratio of the first part to the second part.

2. The golf club head according to claim 1, wherein at least either the first wound portion or the second wound portion is rotatable in a reel-in direction and a reel-out direction.

3. The golf club head according to claim 1, wherein the first wound portion and the second wound portion are rotatable in a reel-in direction and a reel-out direction.

4. The golf club head according to claim 3, wherein each of the first wound portion and the second wound portion includes a rotation regulating mechanism that regulates the rotation of the first wound portion or the second wound portion in the reel-out direction.

5. The golf club head according to claim 1, wherein the golf club head further includes:

a first port that houses the first wound portion including the first part;

a second port that houses the second wound portion including the second part; and a housing recess that houses a third part that is a part of the weight member other than the first part or the second part.

6. The golf club head according to claim 1, wherein the first wound portion and the second wound portion are disposed in the sole portion.

7. The golf club head according to claim 1, wherein the first wound portion and the second wound portion are disposed in the crown portion.

8. The golf club head according to claim 1, wherein the first wound portion is disposed in the sole portion, and the second wound portion is disposed in the crown portion.

9. The golf club head according to claim 1, wherein the golf club head satisfies the following (a) and/or (b):

(a) the golf club head is configured such that the first part wound around the first wound portion is visually recognized from an outside of the golf club head; and (b) the golf club head is configured such that the second part wound around the second wound portion is visually recognized from the outside of the golf club head.

10. The golf club head according to claim 1, wherein the golf club head further includes:

a first port that houses the first wound portion including the first part; and a second port that houses the second wound portion including the second part, wherein the first wound portion is housed in the first port so as not to protrude from an outer surface of the golf club head, and the second wound portion is housed in the second port so as not to protrude from the outer surface of the golf club head.

11. A golf club head including a face portion, a crown portion and a sole portion, the golf club head comprising:

a weight member that is configured to be wound;

a first wound portion around which a first part of the weight member is to be wound; and a second wound portion that is disposed apart from the first wound portion and around which a second part of the weight member is to be wound, wherein a position of a center of gravity of the golf club head is adjusted by changing at least either a wound amount of the first part or a wound amount of the second part.

12. The golf club head according to claim 11, wherein at least either the first wound portion or the second wound portion is rotatable in a reel-in direction and a reel-out direction.

13. The golf club head according to claim 11, wherein the first wound portion and the second wound portion are rotatable in a reel-in direction and a reel-out direction.

14. The golf club head according to claim 13, wherein each of the first wound portion and the second wound portion includes a rotation regulating mechanism that regulates the rotation of the first wound portion or the second wound portion in the reel-out direction.

15. The golf club head according to claim 11, wherein the golf club head further includes:

a first port that houses the first wound portion including the first part;

a second port that houses the second wound portion including the second part; and a housing recess that houses a third part that is a part of the weight member other than the first part or the second part.

16. The golf club head according to claim 11, wherein the first wound portion and the second wound portion are disposed in the sole portion.

17. The golf club head according to claim 11, wherein the first wound portion and the second wound portion are disposed in the crown portion.

18. The golf club head according to claim 11, wherein the first wound portion is disposed in the sole portion, and the second wound portion is disposed in the crown portion.

19. The golf club head according to claim 11, wherein the golf club head satisfies the following (a) and/or (b):

(a) the golf club head is configured such that the first part wound around the first wound portion is visually recognized from an outside of the golf club head; and (b) the golf club head is configured such that the second part wound around the second wound portion is visually recognized from the outside of the golf club head.

20. The golf club head according to claim 11, wherein the golf club head further includes:

a first port that houses the first wound portion including the first part; and a second port that houses the second wound portion including the second part, wherein the first wound portion is housed in the first port so as not to protrude from an outer surface of the golf club head, and the second wound portion is housed in the second port so as not to protrude from the outer surface of the golf club head.

* * * * *